US005592185A

United States Patent [19]

Itabashi et al.

[11] Patent Number: 5,592,185

[45] Date of Patent: Jan. 7, 1997

[54] ANTENNA APPARATUS AND ANTENNA SYSTEM

[75] Inventors: Yasuhiro Itabashi; Kazuhito Miyashita; Yoshiyuki Chatani; Takayoshi Furuno; Hiroaki Miyashita; Toshio Masujima; Makoto Matsunaga; Takashi Katagi; Hiroyuki Aoki; Tetsuo Haruyama, all of Kamakura, Japan

[73] Assignee: Mitsubishi Denki Kabushiki Kaisha, Tokyo, Japan

[21] Appl. No.: 533,382

[22] Filed: Sep. 25, 1995

Related U.S. Application Data

[63] Continuation of Ser. No. 219,011, Mar. 28, 1994, abandoned.

[30] Foreign Application Priority Data

Mar. 30, 1993 [JP] Japan ..... 5-072100
Dec. 15, 1993 [JP] Japan ..... 5-315361

[51] Int. Cl.[6] ..... H01Q 13/20

[52] U.S. Cl. ..... 343/794; 343/767; 343/768; 343/795; 343/872

[58] Field of Search ..... 343/700 MS, 745, 343/746, 747, 767, 768, 794, 795, 806, 816, 820, 853, 872, 873, 770; H01Q 13/20, 13/22

[56] References Cited

U.S. PATENT DOCUMENTS

| | | | |
|---|---|---|---|
| 2,960,694 | 11/1960 | Serniuk | 343/768 |
| 2,983,919 | 5/1961 | Siukola | 343/872 X |
| 3,175,218 | 3/1965 | Goebels | 343/768 |
| 3,239,838 | 3/1966 | Kelleher | 343/872 X |
| 3,268,898 | 8/1966 | Colony | 343/872 X |
| 3,305,871 | 2/1967 | Kruger | 343/872 |
| 4,573,056 | 2/1986 | Dudôme et al. | 343/795 |
| 4,746,925 | 5/1988 | Toriyama | 343/700 MS X |
| 4,825,220 | 4/1989 | Edward et al. | 343/700 MS X |
| 4,914,448 | 4/1990 | Otsuka et al. | 343/700 MS X |
| 5,166,693 | 11/1992 | Nishikawa et al. | 343/700 MS X |
| 5,245,349 | 9/1993 | Harada | 343/700 MS |

FOREIGN PATENT DOCUMENTS

| | | | |
|---|---|---|---|
| 91-042787 | 3/1990 | U.S.S.R. . | |
| 2048571 | 12/1980 | United Kingdom | 343/797 |
| 2191044 | 12/1987 | United Kingdom | H01Q 21/06 |
| 2229322 | 9/1990 | United Kingdom . | |

OTHER PUBLICATIONS

"P. Volta" Microwave Journal vol. 25, No. 12, p. 111 'Design and Development of an Omnidirdectional Antenna w/a Collinear Array . . . ' Dec. 1982.

*Primary Examiner*—Donald T. Hajec
*Assistant Examiner*—Steven Wigmore
*Attorney, Agent, or Firm*—Wolf, Greenfield & Sacks, P.C.

[57] ABSTRACT

An antenna apparatus comprises a dielectric substrate, an earth conductor mounted on one surface of the substrate and forming a microstrip transmission line, an upper conductor mounted on the other surface of the substrate and forming a microstrip transmission line, an antenna element formed integrally with the microstrip transmission lines, and a delayed wave opening situated in the earth conductor in confronting relationship with the upper conductor.

35 Claims, 21 Drawing Sheets

ANTENNA APPARATUS AND ANTENNA SYSTEM

This application is a continuation of application Ser. No. 08/219,011, filed Mar. 28, 1994 now abandoned.

BACKGROUND OF THE INVENTION

1. Field of the Invention

This invention relates to an antenna for use in, for example, a communication base station.

2. Description of the Related Art

Conventionally, the angle of beam orientation of a strip line is fixed.

This conventional feed line unitary antenna is exemplified by a microstrip antenna as shown in FIG. 29 of the accompanying drawings, which is reillustrated from "Handbook of Microstrip Antennas vol. 2" by J. R. James and P. S. Hall, pp. 1076, FIGS. 17 and 18, Peter Peregrinus Ltd., London, United Kingdom, 1989. In FIG. 29, reference numerals 1*a*, 1*b* designate a microstrip antenna; 2, an upper conductor of a microstrip line; 3, an earth conductor; and 4, a dielectric plate.

In FIG. 29, part of the electric power from the microstrip line 2 is supplied to the microstrip antenna 1*a*, and then the electric power passing through the microstrip antenna 1*a* is supplied to the next microstrip antenna 1*b*. As the individual microstrip antennas 1*a*, 1*b* are excited by certain amplitude and phase distribution, the antenna apparatus forms a beam pattern in space. However, the known antenna apparatus has a problem that the angle of beam orientation cannot be varied in the same frequency, as long as the shape of the antenna system such as the length of the feed line and/or the spacing of the antennas are changed. In general, in order to scan the antenna beam, each antenna element is equipped with a phase shifter; however, no low-cost small-size phase shifter suitable for the antenna of FIG. 29 is known at the present time.

FIG. 30 shows an antenna system for performing communication between a number of mobile stations and a data terminal or telephone using the antenna apparatus of FIG. 29.

In FIG. 30, reference numerals 100–102 designate mobile stations each equipped with a transmitter/receiver for communication with another station using a different frequency. A base station (fixed station) 103 includes, transmission/receiving antennas 1, 1', a local oscillator 105, a transmission modulator 104 for modulating transmission signals by a high frequency signal of the local oscillator 105, and first and second receiving demodulators 106, 107 for demodulating receiving signals by a high frequency signal of the local oscillator 105. The base station 103 further includes a line connector 108, a controller 109 for controlling the line connection of the line connector 108, and a communication processor 110 for processing transmission data of the mobile station 100–102 and other data from a data terminal 112, another base station 113, a telephone, etc. The switching between transmission and receiving modes of the base station 103 is performed by switches S1, S2. For receiving transmission data of the mobile station 100–102, as shown in FIG. 30, the antennas 1, 1' are connected with the receiving demodulators 106, 107. For sending predetermined data to the mobile station, the individual switches S1, S2 are connected with the sending modulator 104. During transmission, a switch S3 selectively connects the transmission modulator 104 with one antenna 1 or 1' via the switches S1, S2. The switch S3 selects one of the antennas 1, 1' according to the output level of the first and second receiving demodulators 106, 107, and this switching is controlled by the controller 109. In the antenna system, data received from the mobile station 100–102 is transmitted to the communication processor 110 via the antennas 1, 1', the switches S1, S2, the first and second receiving demodulators 106, 107 and the line connector 108, whereupon the data processed by the communication processor 110 is transmitted to the terminal 112, another base station 113 or the telephone 114 via the public communication network 111. Meanwhile, the data from the terminal, another base station 113 or the telephone 114 is transmitted to the mobile station 100–102 from one of the antennas 1, 1' via the public communication network 111, the communication processor 110, the line connector 108, the transmission modulator 104, the switch S3 and the switch S1 or S2.

In recent years, application of feed line unitary antennas has been on the increase in order to minimize the size of the antennas in the base station. However, with this kind of antenna, the angle of antenna orientation is decided only by the length of the feed line or the spacing of the antenna elements so that for varying or controlling the angle of the antenna, it has been conventional practice to mechanically rotate the antenna.

SUMMARY OF THE INVENTION

It is an object of this invention to provide a low-cost feed line unitary antenna apparatus in which the angle of antenna orientation can be varied without tilting or rotating antennas mechanically and in which a number of variable angles can be obtained discretely or continuously.

With the first arrangement of the invention, since the earth conductor of the microstrip line has delay wave openings in the form of slots and a cutout opening at one end, it is possible to obtain a desired phase of excitation of the antenna element.

With the second arrangement of the invention, it is possible to vary the effective electrical shape of the delay wave opening. Since part or whole of the slots and/or cutout is covered by the regulating plate, it is possible to obtain a desired phase of excitation of the antenna element by varying the extent of superposition between the delay wave opening and the regulating plate to select a suitable effective shape of the slots and cutout.

With the third arrangement of the invention, the substrate carrying the antenna elements and the support plate carrying the regulating plate are supported preferably by means of a screw. A conductive plate having a width smaller than the width of the upper conductor has in its center a threaded hole for receiving the screw. Since the dielectric screw to be secured to the threaded hole is inserted through the elongated hole of the earth conductor, it is possible to support the delay wave regulating structure of the feed line without remarkably impairing the electrical characteristics of the antenna. Assuming that a spring washer is used with the dielectric screw, it is possible to obtain a support mechanism which is resistant against vibration and displacement.

With the fourth arrangement of the invention, in order to continuously vary the effective shape of the delay wave openings in the form of slots and cutouts in the earth conductor, the conductive regulating plate (or the dielectric support plate on which the conductor is formed) covering the slots and cutouts directly or via a dielectric thin film is moved parallel to the earth conductor of the microstrip line.

Accordingly, the delay wave opening can be used as a phase shifter for varying the phase continuously so that the phase of excitation of the antenna element can be continuously varied to a desired value.

With the fifth arrangement of the invention, the antenna elements and the feed line are formed in the dielectric casing, and the regulating mechanism for varying the shape of the slot and cutout in the earth conductor can be driven from outside of the casing. Therefore it is possible, for example, to vary the angle of beam tilt easily without collapsing the antenna apparatus after the antenna apparatus has actually been installed.

With the sixth arrangement of the invention, a slit having a very small width, compared to the wavelength, and dividing the earth conductor into two non-contact portions is formed in a common plane with the earth conductor. At the two non-contact portions near the slit, dipoles to which power is to be supplied via the slit are defined by the conductors of approximately a ¼ wavelength at the frequency in use. Further, since the dipole is connected at a number of steps longitudinally of the microstrip line, it is possible to obtain an inexpensive reduced-height antenna which can be manufactured in the same process with the microstrip line.

With the seventh arrangement of the invention, the conductor of approximately a ¼ wavelength at the frequency in use is situated via a choke in the form of a gap with the earth conductor. Since the choke has such a shape as to reduce reflection from the discrete portion of the slit of the earth conductor at the frequency band in use, it is possible to improve the reflection characteristics of the antenna and, as a result, a highly efficient antenna apparatus can be achieved.

With the eighth arrangement of the invention, the choke has a selected shape so as to have a peak, reducing the reflection from the discrete portion of the slit in the earth conductor, at or around the frequency band in use. Since a dipole is defined by the conductors having approximately a ¼ wavelength and constituting a choke having a different peak frequency, it is possible to suppress the reflection from the discrete portion over a wide range at the entire frequency band in use so that the antenna efficiency can be improved over a wide band range.

With the ninth arrangement of the invention, the two dipoles are located at two positions line symmetrical with respect to the center line in the longitudinal direction of the microstrip line, and each dipole is provided in one or more steps along the microstrip line. Further, since the dielectric plate is substantially equal in dielectric constant, thickness and width to the dielectric plate constituting the microstrip line and the dipoles are superposed over the earth conductor, deterioration of beam pattern due to the difference between vertical dielectric constants of the dipoles can be reduced.

With the tenth arrangement of the invention, in the antenna apparatus composed of a number of antenna elements and a microstrip line as a feed line of the antenna elements, the microstrip line acts as a transmission line. Partly since the earth conductor not to be regarded as part of the antenna elements has a delay wave structure in the form of slots and a cutout opening at one end, partly since the antenna elements are situated in a common plane with the earth conductor, and partly since the dipoles are constituted by conductors of approximately a ¼ wavelength having a slit of very small width, compared to the wavelength, dividing the earth conductor into two electrically non-contact portions, it is possible to obtain a desired phase of excitation of the antenna elements without varying the distance of the individual antenna elements. Further, since the antenna elements are united with the feed line, it is possible to reduce the height of the antenna apparatus to a minimum.

With the eleventh arrangement of the invention, since the dielectric plate covering the delay wave structure in the form of slots or cutouts and being substantially equal in dielectric constant, thickness and width to the dielectric plate constituted by the microstrip line and the dipoles is superposed over the earth conductor of the microstrip line, the dielectric constant of the dielectric plate covering the antenna elements would be isotopic so that a small-height antenna apparatus in which deterioration of the beam pattern is improved and the phase of excitation of the antenna elements is variable can be obtained.

With the twelfth arrangement of the invention, since there is provided a mechanism for moving, in parallel to the earth conductor of the microstrip line, the dielectric plate covering the delay wave structure in the form of slots or cutouts and being substantially equal in dielectric constant, thickness and width to the dipoles, so as to vary the electrical shape of the slots and cutout continuously, the dielectric constant of the dielectric plate covering the antenna elements would be isotopic so that a small-height antenna apparatus in which deterioration of the beam pattern is improved and the phase of excitation of the antenna elements is variable can be obtained.

With the thirteenth arrangement of the invention, since in order to continuously vary the shape of a delay wave structure in the form of slots and cutout in the earth conductor, there is provided a mechanism for moving, in parallel to the earth conductor, the conductor covering the slots and cutout directly or via a dielectric thin film, it is possible to use the delay wave structure as a phase shifter for varying the phase continuously so that the phase of excitation of the antenna can be continuously varied to a desired value.

With the fourteenth arrangement of the invention, partly since there is provided a matching circuit in the form of slots and a cutout opening at one end in the earth conductor of the microstrip line, and partly since in order to vary the electrical shape of the matching circuit, there is provided a conductor, or a dielectric plate with the conductor, covering part or whole of the slots and cutout directly or via an dielectric thin film, it is possible to minimize the change of input impedance, as viewed from the power supply side, by continuously varying the shape of the slots and cutout.

In the antenna apparatus according to the first aspect of the invention, in order to superpose the earth conductor of the microstrip line over the dielectric support plate substantially equal in dielectric constant, thickness and width to the dipoles, the dielectric support plate and the other-than-earth-conductor portion of the microstrip line have holes through which a metal wire is threaded.

In the antenna apparatus according to the second aspect of the invention, in order to superpose the earth conductor of the microstrip line over the dielectric support plate substantially equal in dielectric constant, thickness and width to the dipoles, the dielectric support plate and the microstrip line have holes through which a dielectric clamp is inserted.

In the antenna apparatus according to the third aspect of the invention, in order to superpose the earth conductor of the microstrip line over the dielectric support plate substantially equal in dielectric constant, thickness and width to the dipoles, a low-dielectric-constant foaming agent is filled spaces between the inside surface of the casing and the earth conductor and the support plate.

In the antenna apparatus according to the fourth aspect of the invention, in order to superpose the earth conductor of the microstrip line over the dielectric support plate substantially equal in dielectric constant, thickness and width to the dipoles, a dielectric springy C ring is mounted between the inside surface of the casing and the earth conductor and the support plate.

In the antenna apparatus according to the fifth aspect of the invention, in order to superpose the earth conductor of the microstrip line over the dielectric support plate substantially equal in dielectric constant, thickness and width to the dipoles, two dielectric pipes each having an oval cross section are inserted between the inside surface of the casing and the earth conductor and the support plate.

In the antenna apparatus according to the sixth aspect of the invention, a threaded rod is attached to one end of the dielectric support plate, projecting from the casing.

In the antenna apparatus according to the seventh aspect of the invention, a support plate having a groove is mounted on one end of the dielectric support plate, and a circular disc having a pin received in the groove of the support plate is mounted in the casing.

In the antenna apparatus according to the eighth aspect of the invention, a pin is mounted on one end of the dielectric support plate, and a rod fitted in the pin and a circular disc having a pin, in which the rod is fitted, are mounted in the casing.

In the antenna apparatus according to the ninth aspect of the invention, a support plate is mounted on each of opposite ends of the dielectric support plate, and a shaft having a pulley is mounted in the casing, a V belt being wound around the support plates and the pulley.

In the antenna apparatus according to the tenth aspect of the invention, a support plate is mounted on each of opposite ends of the dielectric support plate, and a shaft having a gear is mounted in the casing, a chain being wound around the support plates and the gear.

In the antenna apparatus according to the eleventh aspect of the invention, a rack is mounted on one end of the dielectric support plate, and a shaft having a pinion is mounted in the casing.

In the antenna apparatus according to the twelfth aspect of the invention, the shaft mounted in the casing has a groove in a portion flat in cross section.

In the antenna apparatus according to the thirteenth aspect of the invention, the shaft mounted in the casing has a knurling tool around the circumferential surface.

In the antenna apparatus according to the fourteenth aspect of the invention, a matching circuit in which the earth conductor of the microstrip line has at portions corresponding to the position of the upper conductor slots and a cutout opening at one end. In order to change the shape of the matching circuit, part or whole of the slots and cutout is covered by a conductor directly or via a dielectric thin film, or by a dielectric plate on which the conductor is provided.

DETAILED DESCRIPTION

Figure 1:
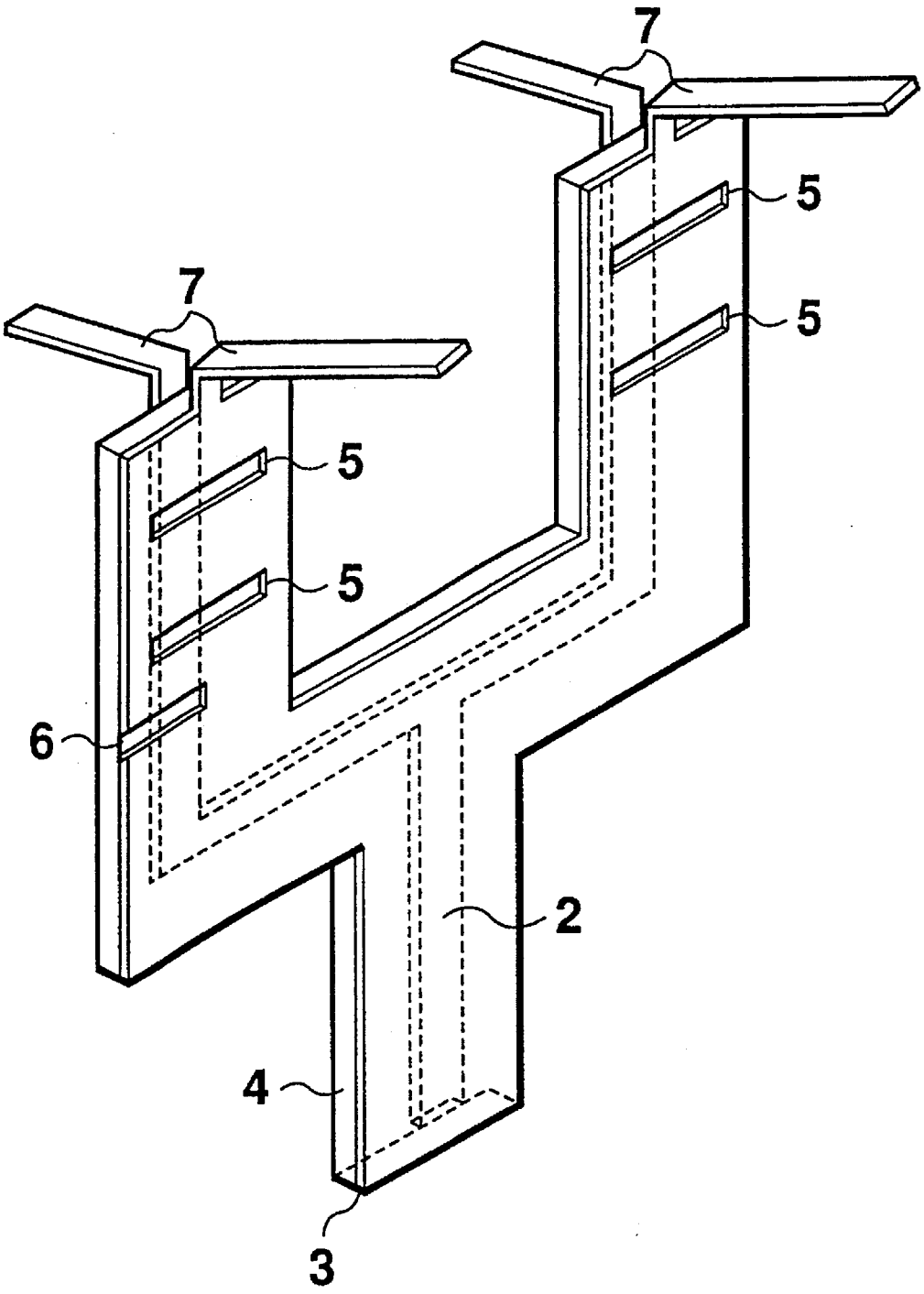
FIG. 1 is a perspective view of an antenna apparatus according to a first embodiment of this invention.

FIG. 1 shows an antenna apparatus according to a first embodiment of tills invention. As shown in FIG. 1, a feed line unitary antenna comprises a strip line formed on upper and lower surfaces of a dielectric substrate 4, and dipole antennas 7 formed on ends of the strip line. An earth conductor 3 is formed substantially over the whole of one surface of the dielectric substrate 4, and an upper conductor 2 having a line width smaller than that of the earth conductor 3 is formed on the other surface of the substrate 4. The dipole antennas 7 are formed on the bifurcated end of the earth conductor 3 and the upper conductor 2 integrally with the strip line.

As a characteristic feature of this invention, part of the earth conductor 3 of the microstrip line has a delay wave opening in a confronting relationship with the upper conductor 2 for regulating the directionality of the antenna by the delay wave amount of the delay wave opening. In the embodiment of FIG. 1, the delay wave opening is a part of the earth conductor 3 of the microstrip line, including a number of slots 5 and a cutout 6, which are located in a confronting relationship with the upper conductor 2.

The operation of the antenna will now be described. Since the length of the slots 5 and cutout 6 is very small compared to the wavelength of signals reached via the microstrip line 2, 3, these delay wave openings are regarded as a serial inductance with respect to the line. Therefore, when passing these openings, the phase of signals will be delayed. Thus the slots 5 and cutout 6 serve as a delay wave element. When power is supplied to the dipoles 7 using the feed line having the delay wave openings, the dipoles 7 will be excited in a phase distribution. Using the phase distribution u=kdsin h, it is possible to obtain a desired angle of orientation of the antenna. The delay wave opening serves as a fixed phase shifter. Here k stands for a frequency, and d stands for the distance between the antennas, According to this embodiment, since the earth conductor 3 of the microstrip line has the delay wave openings in the form of the slots 5 and the cutout 6 opening at one end, it is possible to regulate the phase of excitation of the antenna elements to a desired value by this delay wave opening so that a desired beam pattern of the antenna can be obtained.

As an advantage of this invention, a desired amount of phase shift can be selected by changing the number and position of the slots 5 and cutout 6; for example, it is particularly effective for delay when there is no room for the microstrip line to meander. In the structure of this invention, unlike the microstrip-line-meandering structure, the slots 5 and cutout 6 having a simple shape are formed in the earth conductor by etching, and it would be easy to manufacture an etching mask, which is effective in reducing the cost of the antenna. Further, it is also effective in designing and regulating a feed circuit unitary antenna having a distribution of excitation of an array antenna by selecting a desired length of the slip line.

If the characteristics of the feed circuit unitary antenna does not satisfy a target value of design as the distribution of excitation of antenna elements becomes turbulent due to the mutual coupling between the array elements and between the feed lines, it is necessary to regulate the distribution of excitation of the antenna elements by any means. However, in this case, it is impossible to regulate the feed line length without reconstructing the feed circuit.

According to this invention, by regulating the number, length or width of the slots and cutout to be formed in the earth conductor of the microstrip line to a desired value when etching, it is possible to obtain an antenna in which the delay wave amount can be increased with ease. The phase distribution of excitation of the antenna elements can therefore be regulated. It is possible to control the antenna without remarkably reconstructing the antenna structure.

Further, this invention can be applied if feed circuit includes a microstrip line.

Figure 2:
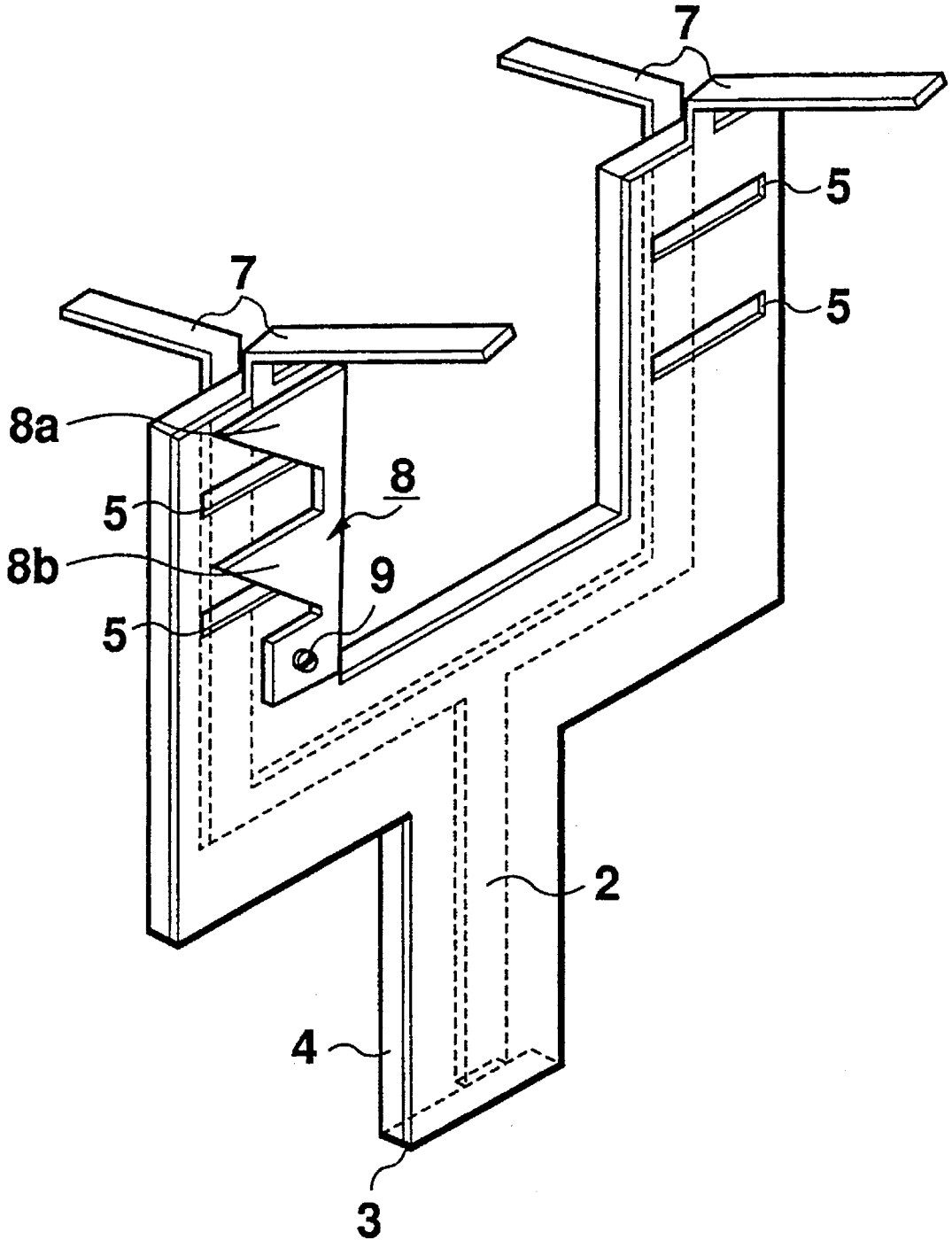
FIG. 2 is a perspective view of an antenna apparatus according to a second embodiment of the invention.

FIG. 2 shows an antenna apparatus according to a second embodiment of the invention. The basic structure of this microstrip-line-unitary antenna is substantially identical with the first embodiment; parts or elements similar to those of the first embodiment are designated by similar reference numerals, and their detailed description is omitted here. As a characteristic feature of the second embodiment, it is possible to regulate the delay wave amount of the delay wave opening easily, and for this purpose, the antenna is equipped with a regulating plate 8. As shown in FIG. 2, the regulating plate 8 is a conductor covering part or all of the delay wave openings or slots 5 directly. The conductive regulating plate 8 is secured to a dielectric substrate 4 by a pin 9, the dielectric substrate 4 carrying the feed line.

The operation of the antenna apparatus of the second embodiment is substantially similar to that of the first embodiment, and only the operation of the regulating plate 8, which is a characteristic feature of the second embodiment, will now be described. As mentioned in connection with the first embodiment, the slots 5 serve as the delay wave openings, and the amount of phase shift is determined by the shape of the slots 5. In the second embodiment, the effective shape of the slots 5 is varied by the conductive regulating plate 8. For this purpose, the regulating plate 8 includes two generally triangular blades 8*a*, 8*b* mounted on one branch of the earth conductor 3 and covering the upper surfaces of the respective slots 5. If different shapes of blades as the regulating plates 8 are prepared, it is possible to select a desired extent of opening of the slots 5 easily by attaching one regulating plate 8 having a desired blade shape to the dielectric substrate 4 by the pin 9 so that the amount of phase shift can be varied to a desired value. This structure has the following advantages. For example, if the feed line unitary array antenna having the same diameter of opening is required to have a number of angles of beam tilt, it is not preferable from a cost point of view to manufacture an antenna having power supply systems for different tilt angles. It is possible to realize an antenna apparatus having different tilt angles easily by using a selected one of different shapes of the conductive regulating plates 8 to cover the slots 5. In this case, since the antenna elements and the microstrip line can be shared, it is very advantageous from a cost point of view. Further, the conductor 8 is mounted on the earth conductor 3 of the microstrip line in intimate contact therewith, thus not negating the advantage that the line is thin. Since the conductor 8 requires only such a size as to cover the slots 5, the width of the earth conductor 3 will not unnecessarily increase.

According to the second embodiment, in order to vary the electrical shape of the delay wave openings, in the form of slots 5 and a cutout opening at one end, in the earth conductor 3 of microstrip line, there is provided the conductive regulating plate 8 for adjustably covering part or all of the slots 5 and cutout 6 directly or via a dielectric thin film. Alternatively, the regulating conductor 8 may be mounted on a dielectric support plate 15. It is therefore possible to vary the phase of excitation of the antenna elements to a desired value by selecting a suitable effective shape of the slots 5 and cutout 6. As a result, a number of antenna beam patterns can be obtained by a single antenna.

In this embodiment, the delay wave openings are slots 5. Alternatively the delay wave openings may be in the form of cutouts 6 as mentioned in the first embodiment 1. The slots 5 and cutout 6 may be used in combination. The regulating plate 8 may include a suitable shape of conductor attached to a dielectric plate. The slots 5 and cutout 6 may be covered by the regulating plate indirectly via a dielectric thin film.

Figure 3:
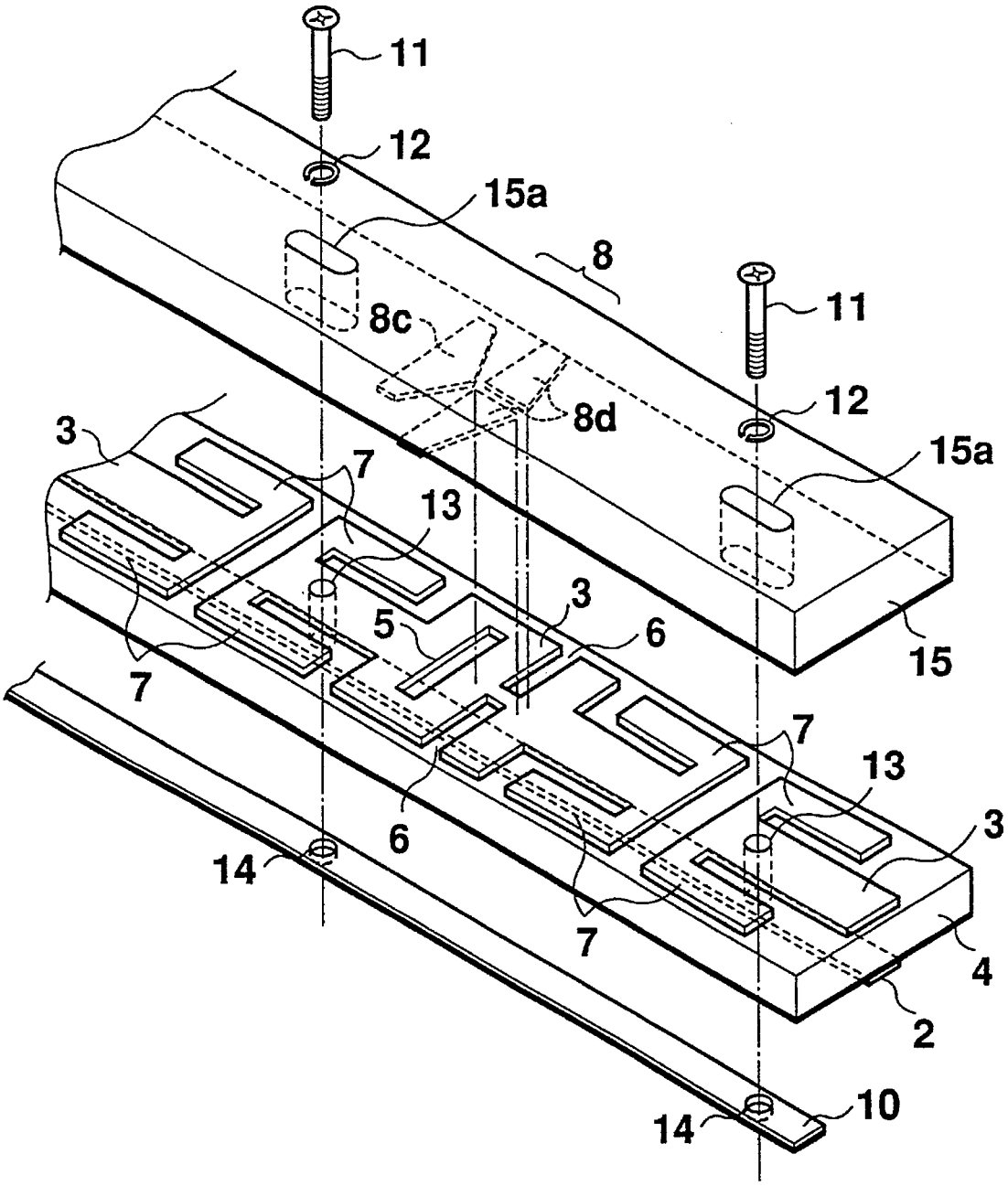
FIG. 3 is a perspective view of an antenna apparatus according to a third embodiment of the invention.

FIG. 3 shows an antenna apparatus according to a third embodiment of the invention. The antenna apparatus of the third embodiment is a microstrip-line-unitary antenna slightly different in shape from the first and second embodiments. A number of earth conductors are arranged in an array on one surface of a bar-shape dielectric substrate 4. On the other surface of the substrate 4, an upper conductor 2 in the form of a narrow strip is mounted common for the earth conductors 3. In the third embodiment, each earth conductor 3 has dipoles 7 on opposite sides of a feed line integrally therewith. The microstrip feed line has a slot and cutouts 6 as shown in FIG. 3.

In the third embodiment, there is provided a regulating plate 8 for selecting an arbitrary effective shape of the delay wave openings in the form of a slot 5 and cutouts 6. The regulating plate 8 is adjustably attached to the substrate 4 so that the opening area of the slot 5 and cutouts 6 can be varied with maximum ease.

As shown in FIG. 3, the regulating plate 8 includes a first conductor 8*c* for covering the slot 5, and a second conductor 8*d* for covering the two cutouts 6, the two regulating conductors 8*c*, 8*d* being mounted on the lower surface of a dielectric support plate 15. The support plate 15 is superposed over the dielectric substrate 4 in such a manner that the two regulating conductors 8*c*, 8*d* are brought into intimate contact with the slot 5 and the cutouts 6, respectively. The support plate 15 is adjustably attached to the dielectric substrate 4 by a screw 11. Specifically, the support plate 15 has an elongated hole 15*a*, and likewise the dielectric substrate 4 has a through-hole 13, the screw 11 extending through the elongated hole 15*a* and the through-hole 13 via a spring washer 12. A conductive receiving plate 10 is mounted on the microstrip line side of the dielectric substrate 4, and the screw 11 threadedly extends to a threaded hole 14 of the receiving plate 10. The support plate 15 is longitudinally movable relative to the substrate 4 within a range of the elongated hole 15*a*. By moving the support plate 15 with respect to the substrate 4, it is possible to vary the area of the slot 5 and cutouts 6 to be covered with the regulating conductors 8*c*, 8*d* so that the delay wave amount and angle of orientation of antenna can be adjusted as desired.

The operation of the antenna apparatus of the third embodiment will now be described. In this embodiment, the dielectric substrate 4 on which the dipoles 7 and the feed line is clamped and fixed between the receiving plate 10 and the support plate 15 carrying the regulating plate 8. As these parts are stably fixed by screws, it is possible to retard deformation of parts due to the change of environment of vibration and material.

As an advantageous feature of this embodiment, there is provided the receiving plate 10 for fixing the regulating plate 8 carrying the support plate 15. Since the receiving plate 10 has a width smaller than that of the upper conductor 2 of the microstrip line and is superposed over and fixed to the upper conductor 2 so that any part of the receiving plate 10 does not project from the upper conductor 2 sideways, the electric characteristic of the microstrip line is virtually the same when compared to that in the absence of the receiving plate 10. It is therefore easy to design the feed line using the ordinary microstrip line analysis. Since the receiving plate 10 is formed within the width of the dielectric substrate 4 and the support plate 15, it is possible to save space. If the material of the fastening screws is a dielectric having a dielectric constant which is virtually equals to that of the dielectric substrate 4 carrying the microstrip line, reflection from portions around the screws 11 will not be changed very much.

With this arrangement, it is possible to support the delay wave opening of the feed line without causing substantial damage to the electric characteristic of the antenna. If spring washers 12 are used with the dielectric screws 11, an improved support mechanism more resistant against vibration and displacement can be achieved, giving a stable electric characteristic.

In this embodiment, the fastening screw 11 is inserted through the elongate hole 15*a* via a spring washer 12. This structure has the following advantage. By moving the support plate 15 on the dielectric substrate 4 longitudinally of the antenna after the support plate 15 is mounted on the substrate 4, it is possible to vary the amount of phase shift by changing the electrical shape of the slot 5 and cutouts 6 to an effective value so that the direction of main beam of the antenna can be changed. In this case, it is possible to keep the dielectric substrate 4 and the support plate 15 stably in a fixed state under the resilience of the spring washer 12 without retightening the fastening screws 11.

This embodiment is also useful when it is not necessary to move the support plate on the dielectric substrate 4.

In an alternative form, the dedicated upper conductor 2 of the microstrip line may be omitted, and the conductive receiving plate 10 may also serve as the upper conductor. Thus the receiving plate 10 is a support mechanism and the upper conductor of the microstrip line. With this arrangement, it is possible to reduce the number of parts, and only one surface of the dielectric substrate 4 must be etched, thus reducing the cost of production.

In FIG. 3, the receiving plate 10 is an elongated conductor extending longitudinally along the microstrip line. Alternatively, the receiving plate 10 may be a number of short conductors each having a threaded hole 14, and the short conductors may be arranged discretely to receive the respective screws 11.

Figure 4:
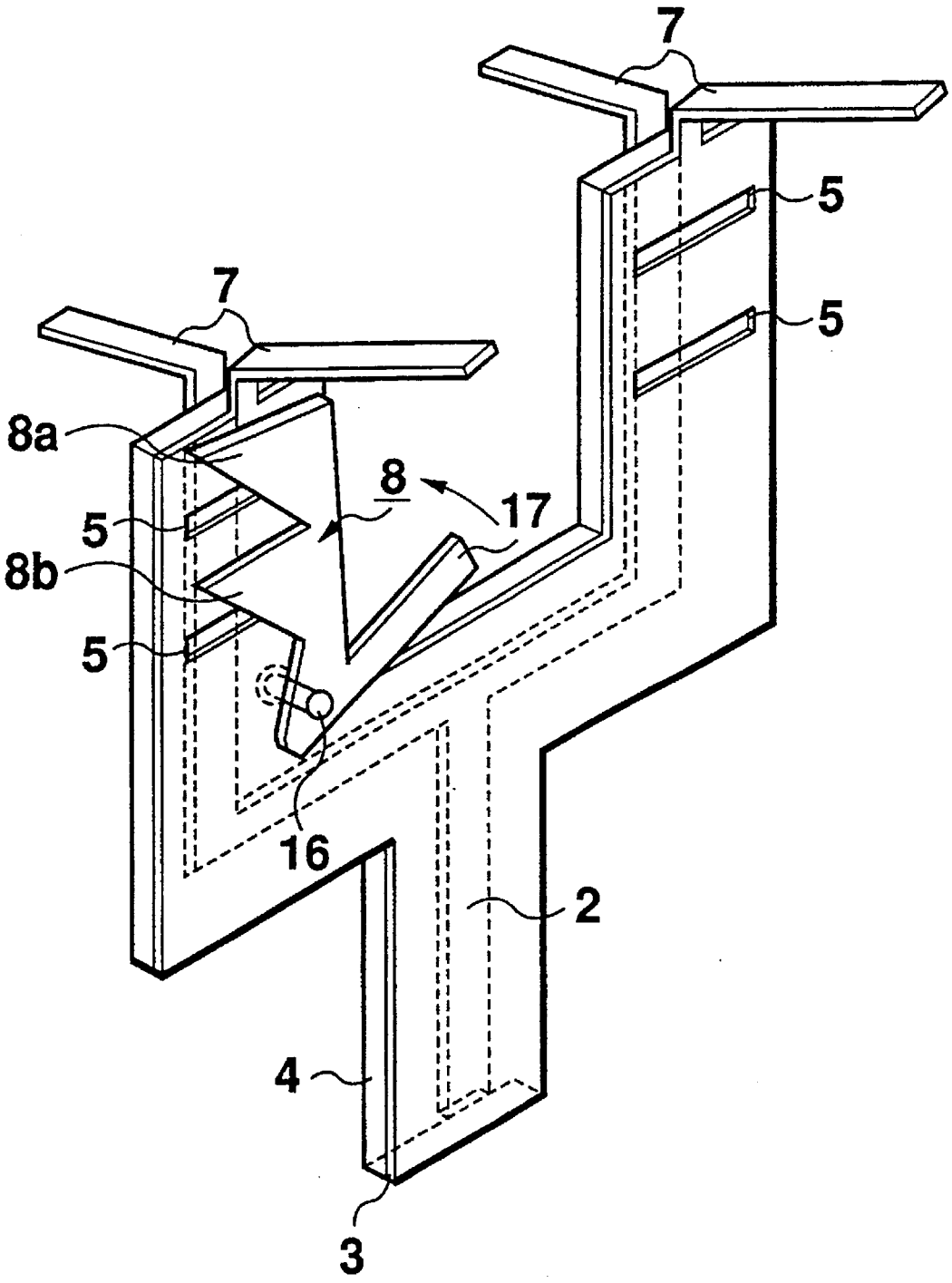
FIG. 4 is a perspective view of an antenna apparatus according to a fourth embodiment of the invention.

FIG. 4 shows an antenna apparatus according to a fourth embodiment of the invention. The fourth embodiment is an improvement of the second embodiment; parts or elements to those of the second embodiment are designated by similar reference numerals, and their detailed description is omitted here.

A characteristic feature of the fourth embodiment is that the regulating plate 8 can be easily adjusted on the substrate 4 to adjustably cover the slots 5. As a result, the opening area of the slots 5 can be easily regulated and a desired angle of beam orientation can be obtained. The regulating plate 8 of the fourth embodiment is different from that of FIG. 2 in that it is movably mounted on the substrate 4 by a semi-fixed pin 16. The regulating plate 8 has on its rear end a lever 17 which serves to select an arbitrary position of the regulating plate 8.

The operation of the antenna apparatus of the fourth embodiment will now be described. As the shape of the delay wave opening or slots 5 is continuously varied, the phase will also vary continuously. By varying the covered area of the slots 5 by the lever 17 of the regulating plate 8, it is possible to select a desired phase shift characteristic of the antenna continuously. For example, the orientation of the main beam can be varied continuously. It has been customary to use a digital phase shifter as a phase shift mechanism of the phased array antenna; for example, a digital phase shifter is not useful from a cost point of view in the case where the beam orientation must be finely adjusted as required when installing an antenna for a base station to cover only a certain service area, and then the beam orientation must be fixed. Consequently a low-cost analog phase shifter would be required. According to this embodiment, a low-cost phase shifter in which the feed circuit is excellently unitary can be realized. This invention should by no means be limited to the base station. For example, it may be used in a moving communication terminal. In this case, a low-cost and main-beam-orientation-variable array antenna can be obtained in which even if the direction of location of the base station varies continuously, a stable communication is possible by scanning the main beam continuously.

With this arrangement, since there is provided the mechanism for moving the conductive regulating plate 8, which covers the slots 5 to vary the effective shape of the delay wave opening or slots 5, in parallel to the earth conductor 3 of the microstrip line, the delay wave opening can be used as a phase shifter for varying the phase continuously. Further, since the phase of excitation of the antenna can be varied continuously to a desired value, it is possible to vary the shape of the beam pattern continuously.

Figure 5:
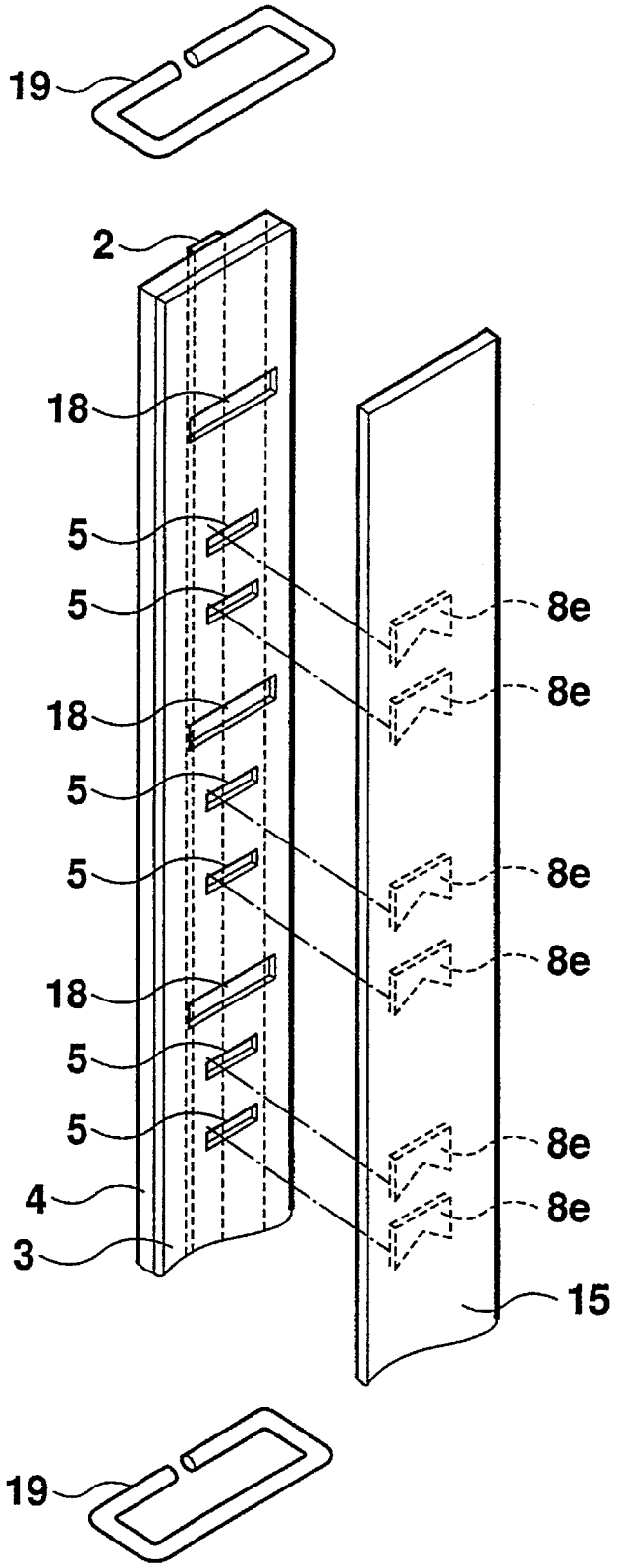
FIG. 5 is a fragmentary exploded perspective view of an antenna part of an antenna apparatus according to a fifth embodiment of the invention.
Figure 6:
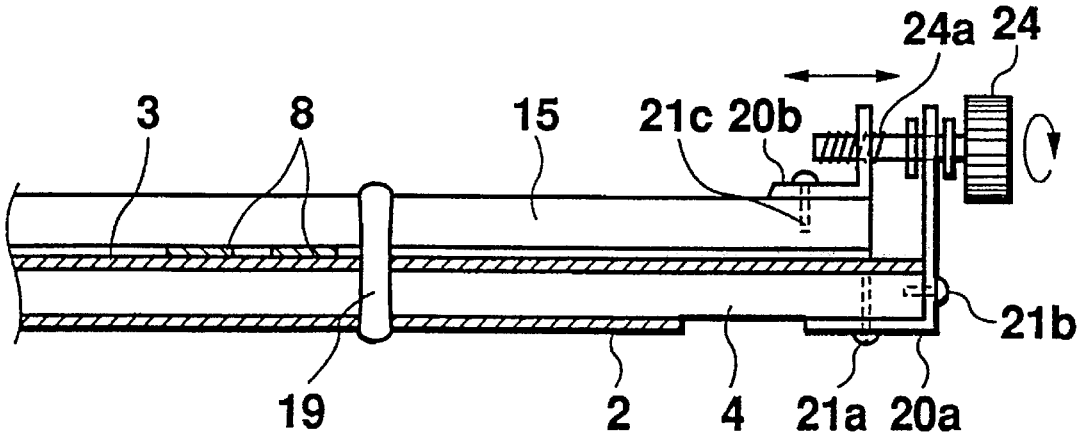
FIG. 6 is a front view of the antenna apparatus of the fifth embodiment.

FIGS. 5 and 6 show an antenna apparatus according to a fifth embodiment of the invention, in which the effective area of the delay wave opening can be varied. The antenna apparatus of the fifth embodiment is a slot antenna, in which a belt-like upper conductor 2 is mounted on one surface of a dielectric substrate 4, and an earth conductor 3 having a number of radiating slots 18 is mounted on the other surface of the dielectric substrate 4, the two conductors 2, 3 jointly constituting a microstrip line likewise the foregoing embodiments. The microstrip line of the earth conductor 3 has a number of slots between the radiating slots 18; a desired amount of delay wave and a desired angle of orientation of the antenna can be selected by varying the effective opening area of the slots 5. In order to regulate the effective opening area of the individual slots 5, a number of conductive regulating plates 8*e* carried by the support plate 15 is superposed over the earth conductor 3 so as to cover the individual slots 5. Each regulating plate 8*e* has a V-shape lower end, and as a result, if the support plate 15 is shifted longitudinally with respect to the dielectric substrate 4, the slots 5 can be covered to a desired extent by the regulating plates 8*e*. In this embodiment, partly since the dielectric substrate 3 and the support plate 15 are superposed over in intimate contact with one another by a number of clips 19 as shown in FIGS. 5 and 6, and partly since the clips 19 are made of plastics, the support plate 15 can slide longitudinally with respect to the substrate 4. A mechanism for sliding the support plate 15 on the substrate 4 is shown in FIG. 6, in which an L-shape bracket 20*a* is secured to one end of the substrate 4 by screws 21*a*, 21*b*, and an adjusting screw 24 is axially immovably but rotatably attached to one end of the bracket 20*a*.

On the other side, another L-shape bracket 20*b* is secured to the corresponding end of the support plate 15, and a threaded portion 24*a* of the adjusting screw 24 is threadedly engaged with the bracket 20*b*. Therefore, by turning the adjusting screw 24, it is possible to slide the support plate 15 longitudinally on the substrate 4.

The operation of the antenna apparatus of the fifth embodiment will now be described. In this embodiment, the radiating slots 18 are designed in such a size as to resonate and radiate at a target frequency and is seen as a virtually pure resistance as viewed from the feed line. The slots 5 as the delay wave opening are designed so as to be a series inductance as viewed from the feed line, and radiation from the slots 5 is negligibly small compared to the radiating slots 18. The slots 5 are partly or wholly masked by the regulating plates 8*e* which vary the slot shape. The regulating plates 8*e* are mounted on the surface of the dielectric support plate 15. If the dielectric support plate 15 is a thin film, it may be turned upside down and attached to the earth conductor 3 in intimate contact therewith. Signals are supplied in the travelling wave from one of the upper and earth conductors 2, 3; signals are supplied to the radiating slots 18 one after another while they are delayed by the delay wave opening or slots 5. Therefore, the individual slots 18 serve as an array antenna which is fed in a desired phase of excitation. Further, when the dielectric support plate 15 is continuously displaced axially of the antenna to vary the shape of the slots 5 and hence the amount of phase shift, it is possible to vary the antenna beam pattern continuously. As the most simple example, the length of the microstrip line between the nearest two slots 18 is about integer times the wavelength, and the selected distance d of the slots 18 is $d<k/(1+\sinh)$ (k is the wavelength, and h is the main beam orientation) so that the array of the radiating slots 18 will not cause a grating lobe. There are, between the radiating slots 18, as many delay wave slots 5 as the frequency of phase shift required for antenna beam scanning. For example, in the case where the delay wave slots 5 are in pairs, it is possible to reduce reflection of the slot pairs if the distance of the slots 5 is approximately ¼ wavelength of the feed line. With this arrangement, partly since the antenna apparatus presents the main beam to be radiated substantially along the plane perpendicular to the axis of the antenna, and partly since the dielectric substrate 4 and the regulating support plate 15 are relatively moved, it is possible to continuously scan the main beam in the vertical plane. The antenna moving mechanism is preferably of the structure as shown in FIG. 6. The dielectric substrate 4 and the support plate 15 are mutually slidably supported by the dielectric clips 19; for a displacement between the substrate 4 and the support plate 15, it is only necessary to turn the adjusting screw 24. With this structure, since the beam orientation of the antenna varies according to the angle of rotation of the adjusting screw 24, it is possible to facilitate operating the antenna apparatus.

Figure 7:
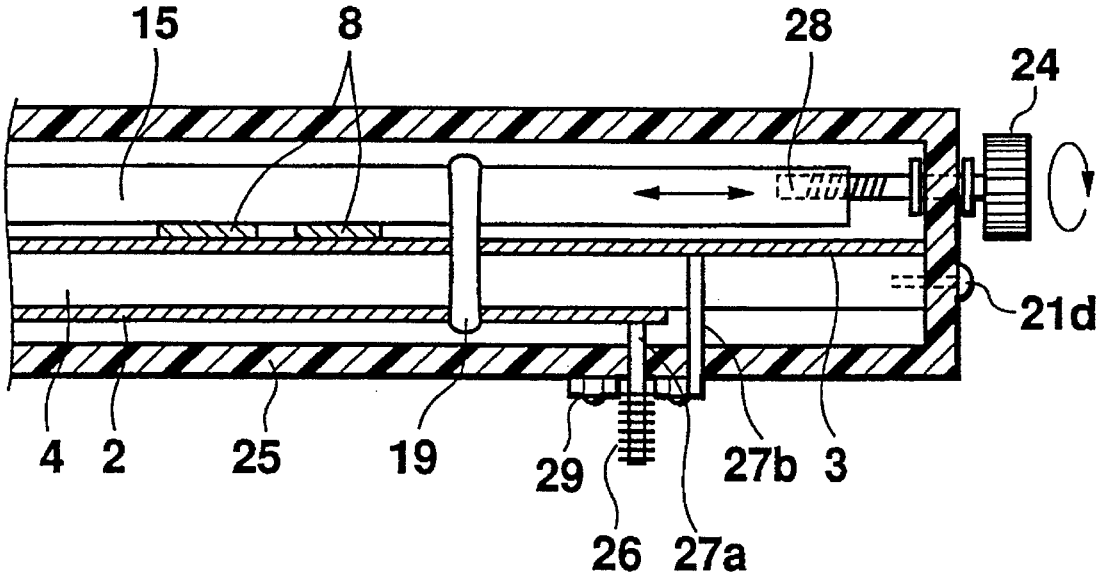
FIG. 7 is a fragmentary cross-sectional view of an antenna apparatus according to a sixth embodiment of the invention.

FIG. 7 is a cross-sectional view showing an antenna apparatus according to a sixth embodiment of the invention. The sixth embodiment has a structure in which the antenna of the fifth embodiment is accommodated in a casing; therefore, parts or elements similar to those of the fifth embodiment are designated by similar reference numerals, and their detailed description is omitted here.

In the sixth embodiment, the support plate 15 carrying the regulating plate 8 is superposed over the dielectric substrate 4 carrying the microstrip feed line as a unit by the dielectric clips 19, and the substrate 4 is secured to one end of the casing 25 by a screw 21*d*. On the side wall of the casing 25, an adjusting screw 24 is rotatably but axially immovably attached, with its threaded tip end threadedly extending into a threaded hole 28 of the support plate 15. Therefore the support plate 15 can be adjusted longitudinally on the substrate 4 according to the rotation of the adjusting screw 24, and a desired directional angle of the array antenna can be selected.

Terminal pins 27*a*, 27*b* are respectively connected to the upper conductor 2 and the earth conductor 3, which are mounted on opposite surfaces of the substrate 4. The terminal pins 27*a*, 27*b* have lower ends projecting outwardly from the casing 25 to be electrically connected to a power supply connector 26. The power supply connector 26 is secured to the outer surface of the casing 25 by screws 29.

The operation of the antenna apparatus of the sixth embodiment will now be described. The operation of the electrical system of this embodiment is similar to that of the fifth embodiment. In general, the antenna is accommodated in the casing in order to improve the goodness of fit to the environment of the installation. In the sixth embodiment, the antenna of FIG. 5 is mounted in the dielectric casing 25. For power supply to the antenna, a core 27*a* of the power supply connector 26 is connected to the upper conductor 2 of the microstrip line, and an external conductor of the connected is connected to the earth conductor 3 via a short-circuit line 27. Power is supplied to the antenna from the connector 26, and the angle of antenna beam tilt is adjusted by rotating the adjusting screw 24. The advantage of this embodiment is that it is possible to adjust the angle of antenna beam tilt after the antenna has been installed, so that the orientation of the antenna can be varied without any laborious work such as removing and disassembling the antenna.

According to the sixth embodiment, the antenna elements and the feed line are formed in the electric casing 25, and the moving mechanism for varying the shape of slots and cutout in the earth conductor 3 of the microstrip feed line is driven from outside of the casing 25. It is therefore possible to vary the angle of beam tilt after the antenna apparatus has actually been installed, without disassembling the antenna.

Figure 8:
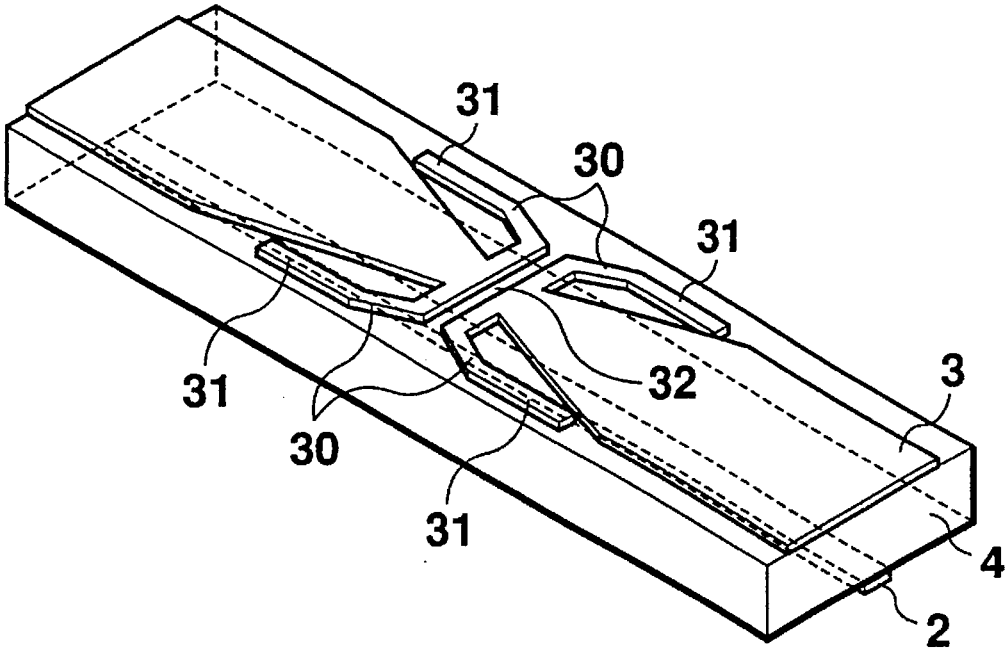
FIG. 8 is a perspective view of an antenna apparatus according to a seventh embodiment of the invention.

FIG. 8 is a perspective view showing an antenna apparatus according to a seventh embodiment of the invention. In the seventh embodiment, the earth conductor 3 and the upper conductor 2 are mounted respectively on opposite surfaces of the dielectric substrate 4 to jointly constitute the microstrip line for the antenna. The earth conductor 3 is divided into two electrically non-contact portions by a slit 32, whose width is very small compared to the wavelength of the target frequency. Near to the slit 32, dipole antennas 30 are formed integrally with the earth conductor 3 so that a desired antenna beam can be obtained. In each dipole antenna 30, a conductor 31 having a length of approximately ¼ wavelength in the target frequency constitutes a dipole for the individual antenna.

The operation of the antenna apparatus of the seventh embodiment will now be described. When a signal running in the microstrip line composed of the earth conductor 3 and the upper conductor 2 reaches the slit 32, a potential difference is created between the two earth conductor portions 3 so that the dipoles 30 will be excited to radiate electric waves into the air. In FIG. 8, the two dipoles 30 are used. Alternatively, only one dipole 30 may be used. Thus it is possible to form the dipoles in the earth conductor 3 of the microstrip line. Further, in FIG. 8, each of the dipoles 30 is of a single-step structure. Alternatively the dipoles 30 may be of a multi-step structure so that an array antenna can be obtained. An advantage of the seventh embodiment is that since the dipoles 30 are accommodated within the earth conductor 3 of the strip line, the antenna is reduced in height. Further, since the feed line and the antenna are unitary, an improved manufacturing process can be realized. From an electrical view point, the dipoles 30 have an advantage. For example, when matching the dipoles 30, their main adjusting parameters are the length of the conductor 31 of approximately ¼ wavelength and the width of the slit 32 so that an increased degree of freedom can be achieved, thus causing the following advantage. Assuming that the dipoles 30 are to be arranged in array longitudinally of the feed line and that the array antenna gain is to be maximal by uniform excitation distribution, it is necessary to reduce the extent of coupling between the dipoles 30 and the feed line for the antenna element near the power supply point of the feed line and to increase it for the antenna element remote from the power supply point. Because the electric power of the signal running in the feed line is attenuated gradually as the antenna elements radiate. Conventionally, in order to regulate the extent of connection between the feed line and the dipoles 30, it has been suitable to adjust the width of the slit 32 and the length of the conductor 31. Whereas in this invention, since there are two parameters, i.e., the width of the slit 32 and the length of the conductor 31, easy adjustment can be achieved. As the result of adjustment, if the dipoles 30 are seen as a pure resistance as viewed from the feed line, the phase at the dipoles 30 does not vary. It is therefore possible to estimate the power supply phase of the dipoles, and thus easily facilitate design of the antenna. With this arrangement, there is more than one main adjusting parameter, and it is possible to adjust the impedance of the dipoles 30 so as to approach a pure resistance.

In this embodiment, the slit 32 having a very small width compared to the wavelength is situated in a common plane with the earth conductor 3 of the microstrip line, dividing the earth conductor 3 into two electrically non-contact portions. Each of the two earth conductor portions near the slit 32 is provided with dipoles 30 to which power is to be supplied via the slit 32, each dipole 30 including a conductor 31 of approximately ¼ wavelength at the target frequency. Further, since the dipoles 30 are connected in multiple steps longitudinally of the microstrip line, it is possible to obtain an inexpensive antenna apparatus which is small in height and can be manufactured in the same manufacturing process with the microstrip line.

Figure 9:
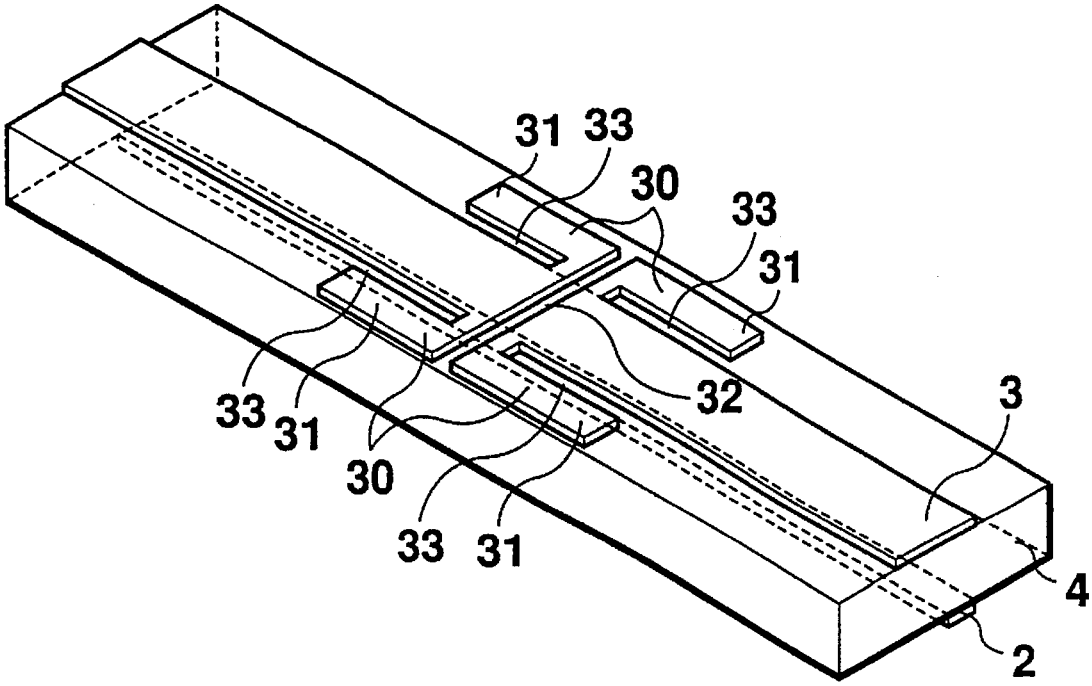
FIG. 9 is a perspective view of an antenna apparatus according to an eighth embodiment of the invention.

FIG. 9 is a perspective view showing an antenna apparatus according to an eighth embodiment of the invention. The eighth embodiment is similar to the seventh embodiment except that there is provided a choke 33 for minimizing reflection from the slit 32 in the target frequency band. The choke 33 is in the form of a gap between the conductors 31, which serve as dipole antennas, and the earth conductor 3.

The operation of the antenna apparatus of the eighth embodiment will now be described. The dipoles 30 have chokes 33 each defined between the conductor 31 and the earth conductor 3. The choke 33 has a selected length of approximately ¼ wavelength so as to minimize reflection from the slit 32 in the target frequency band. In this embodiment, the choke 33 is in the form of a slot line opening at one end of approximately ¼ wavelength in the target frequency band. Since the slot line opens at one end as shown in FIG. 9, the vicinity of the slit 32 is seen to be electrically short-circuited so that separation by the slit 32 of the earth conductor 3 is reduced. Also in FIG. 9, since there are four chokes 33, reflection due to the separation of the slit 32 is unlikely to occur so that it is very advantageous in matching the feed line unitary antenna. This structure is also effective when the dipoles 30 are arranged in array in multiple steps longitudinally of the feed line, causing the same advantageous result. If the dipole antennas are in array in particular, it would cause the following new advantageous result. Consider an array antenna in which the dipoles are connected in multiple steps via the microstrip line having a length of approximately integer times the wavelength. In the array antenna, there exists the slit 32 which is separation of the feed line at the position of approximately integer times the wavelength. The microstrip line having separation at opposite ends and having a length of approximately integer times the wavelength serves as a resonator and, as a result, a standing wave current would occur from the resonation chiefly on the earth conductor 3 and then it would be strongly radiated. Under the influence of the unnecessary radiation, the characteristic of the array antenna would be remarkably deteriorated. Therefore it would be important to prevent such resonation. According to this invention, however, since reflection from the slit 32 is reduced, any resonation mode corresponding to the resonation does not stably exist so that the above-mentioned unnecessary radiation can be reduced effectively.

According to the eighth embodiment, the choke 33 is a gap between the conductor 31 of approximately ¼ wavelength in the target frequency and the earth conductor 3 of the microstrip line. The choke 33 has a shape such as to reduce reflection from the discrete portion or slit 32 of the earth conductor 3 in the target frequency band, thus improving the reflection characteristic of the antenna. As a result, a high-efficient antenna apparatus can be obtained.

In this embodiment, the two dipoles 30 are connected with the slit 32. Alternatively, a single dipole 30 may be provided for each slit 32.

Figure 10:
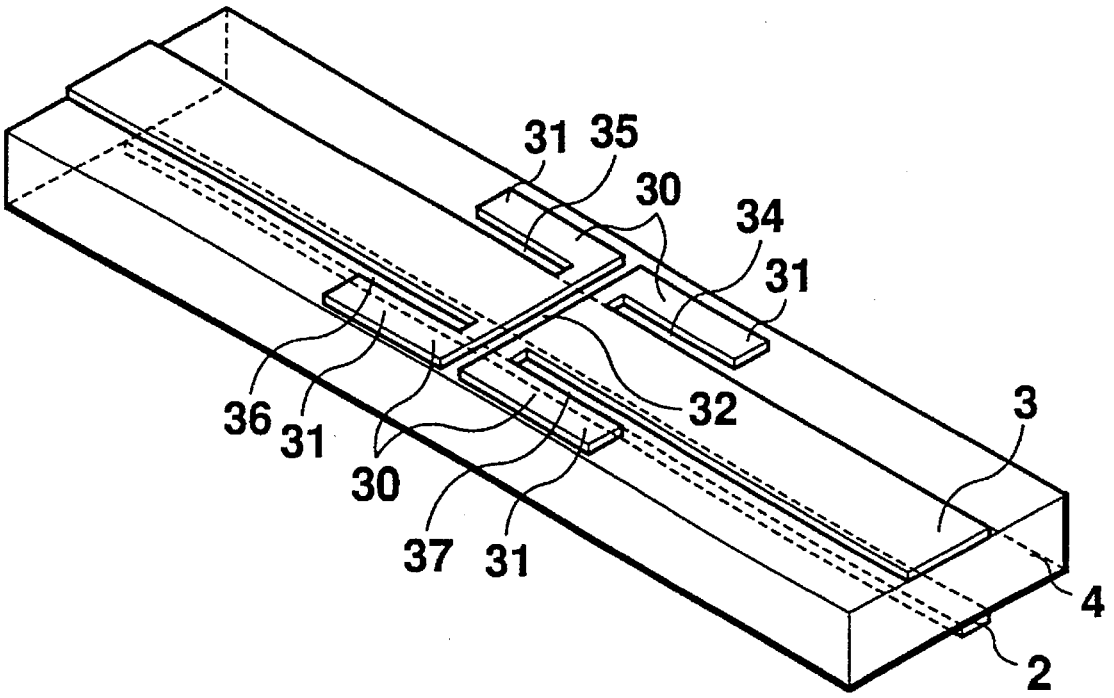
FIG. 10 is a perspective view of an antenna apparatus according to a ninth embodiment of the invention.

FIG. 10 is a perspective view showing an antenna apparatus according to a ninth embodiment of the invention. In FIG. 10, reference numerals 34, 35, 36, 37 designate chokes each having a optimum frequency in canceling reflection from the slit 32 in or about the target frequency band. Two chokes 34, 35, 36, 37 constituting a single dipole 30 have different peaks.

The operation of the antenna apparatus of the ninth embodiment will now be described. According to the ninth embodiment, in the antenna apparatus of the eighth embodiment, there are provided a number of chokes of different lengths. The individual choke 34, 35, 36, 37 have a peak in canceling reflection from the slit 32 in or about the target frequency band. A pair of chokes constituting a single dipole have different peaks. Specifically, in FIG. 10, assume that the chokes 34, 35 have different peaks while the chokes 36, 37 have different peaks. However, it is not necessary that each pair of chokes 34, 35 (36, 37) has a different shape. This invention is particularly effective when used in the following applications. For example, when the target frequency band of the antenna is wide, the choke 33 of the eighth embodiment cannot effectively cancel reflection from the slit in the entire band on some occasions. Whereas in the ninth embodiment, it is possible to reduce reflection from the slit 32 over a wide frequency band for the following reason. Assuming that, as shown in FIG. 10, the choke 34 is relatively long and the choke 35 is relatively short, the long choke 34 reduces reflection from the slit 32 in the lower part of the target frequency band, while the short choke 35 reduces reflection from the slit 32 in the higher part of the target frequency band. As a result, it is possible to reduce reflection from the slit 32 effectively in the target frequency band. If the target frequency band can be covered by the two chokes 34, 35, the chokes 35, 36 may be identical in shape with the chokes 36, 37. If the target frequency band is much wider, the lengths of the chokes 34, 35, 36, 37 having the respective peaks about four frequencies f1–f4: f1=fL, f2=fL+d, f3=fL+2d and f4=fH, where fL is the lowermost frequency of the target band, fH is the highest frequency, and d=(fH−fL)/3. For example, the chokes 34, 35, 36, 37 correspond to f1, f3, f2, f4, respectively.

According to the ninth embodiment, the shapes of the chokes 34, 35, 36, 37 have peaks in reducing reflection from the discrete portions or slits 32 in or about the target frequency band. A pair of conductors having a length of approximately ¼ wavelength and defining each pair of chokes 34, 35 (36, 37) having different peaks constitutes a single dipole 30. Therefore reflection from the discrete portion is retarded over the entire target frequency band, and an antenna apparatus much more efficient in a wide frequency band can be realized.

Figure 11:
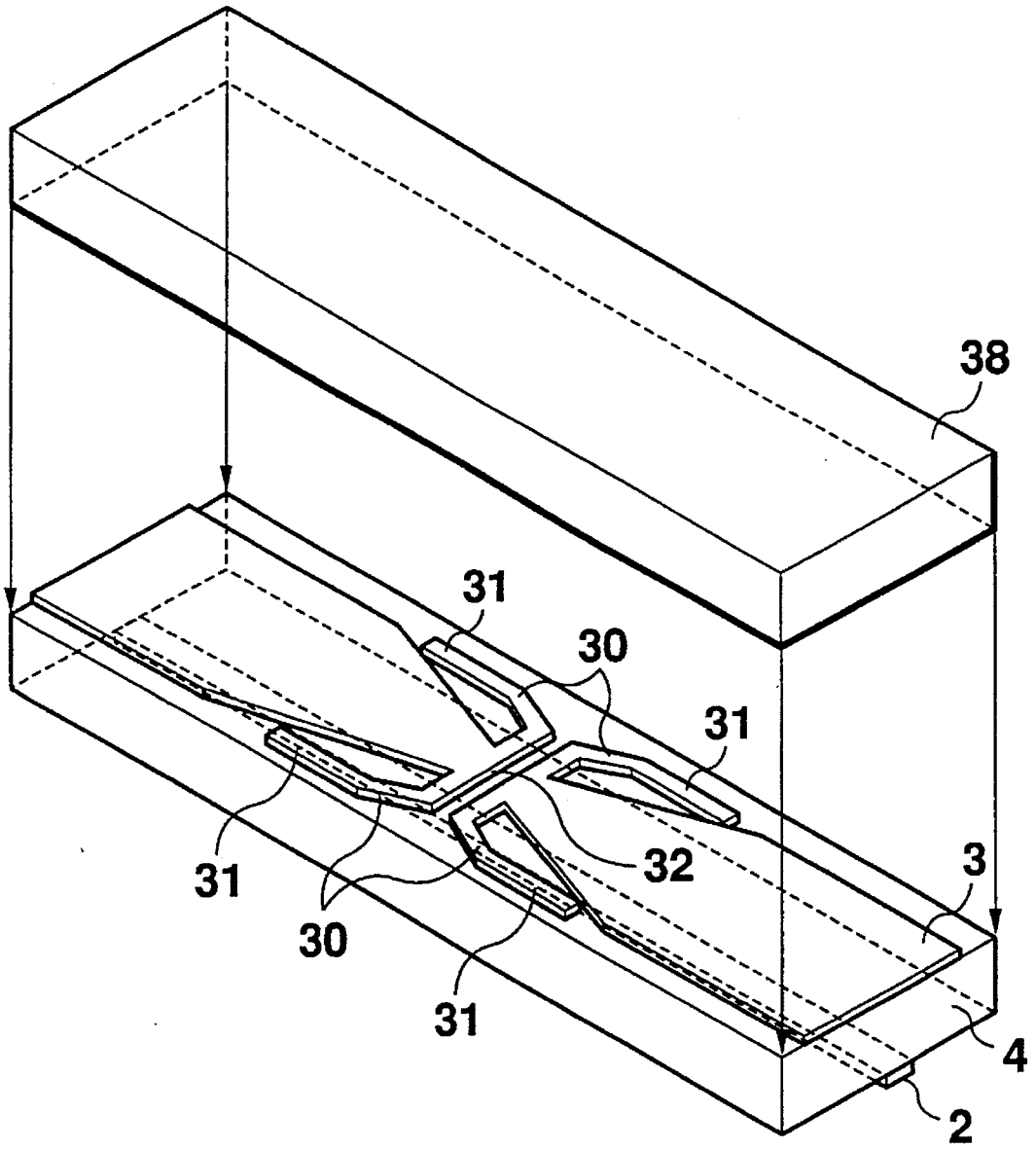
FIG. 11 is a perspective view of an antenna apparatus according to a tenth embodiment of the invention.

FIG. 11 is a perspective view showing an antenna apparatus according to a tenth embodiment of the invention. In FIG. 11, a dielectric cover plate 38 covers in intimate contact a dielectric substrate 4 carrying an earth conductor 3 of the microstrip line. The cover plate 38 is substantially equal in dielectric constant, thickness and width to the dielectric substrate 4. Two dipoles 30 are located in positions line symmetrical with respect to the center line of the length of the microstrip line.

The operation of the antenna apparatus of the tenth embodiment will now be described. According to this embodiment, the radiation characteristic of the antenna varies a little when the antenna is turned by 180 degrees about the center line of the length of the microstrip line. It is a common knowledge that the characteristic of the dielectric substrate 4 and the dielectric cover plate 38 about the dipole 30 exerts significant influence on the radiation of the antenna. In this invention, the dielectric cover plate 38 and the dielectric substrate 4 are arranged in symmetry with respect to the dipole 30 in such a manner that their electrical characteristics are substantially the same. If the gap between the two dipoles 30 is very small compared to the wavelength, it is possible to obtain a non-directional characteristic in a plane perpendicularly to the longitudinal direction of the antenna. In this case, it is particularly important that the dielectric substrate 4 and the dielectric cover plate 38 have the same electrical characteristic. Especially if the dipoles 30 are arranged in array longitudinally of the antenna and if the dielectric substrate 4 requires an adequate strength such that the antenna will not be bent, the dielectric substrate 4 must be somewhat larger in thickness and higher in dielectric constant. In this case, the beam pattern in the direction where the dielectric substrate 4 exists and that in the direction where the dielectric substrate 4 does not exist would become considerably asymmetrical. This embodiment reduces this asymmetry.

According to the tenth embodiment, two dipoles 30 are located in positions line symmetrical with respect to the center line of the line of the microstrip line. The two dipoles 30 are arranged in one step or multiple steps longitudinally of the microstrip line. Further, the dielectric cover plate 38, which is substantially equal in dielectric constant, thickness and width to the substrate 4 carrying the microstrip line and the dipoles 30, is superposed over the earth conductor 3 of the microstrip line. It is thereby possible to reduce deterioration of the radiation pattern due to the difference in dielectric constant in the upward and downward directions of the dipoles 30 so that an antenna apparatus having a good symmetry can be achieved.

Figure 12:
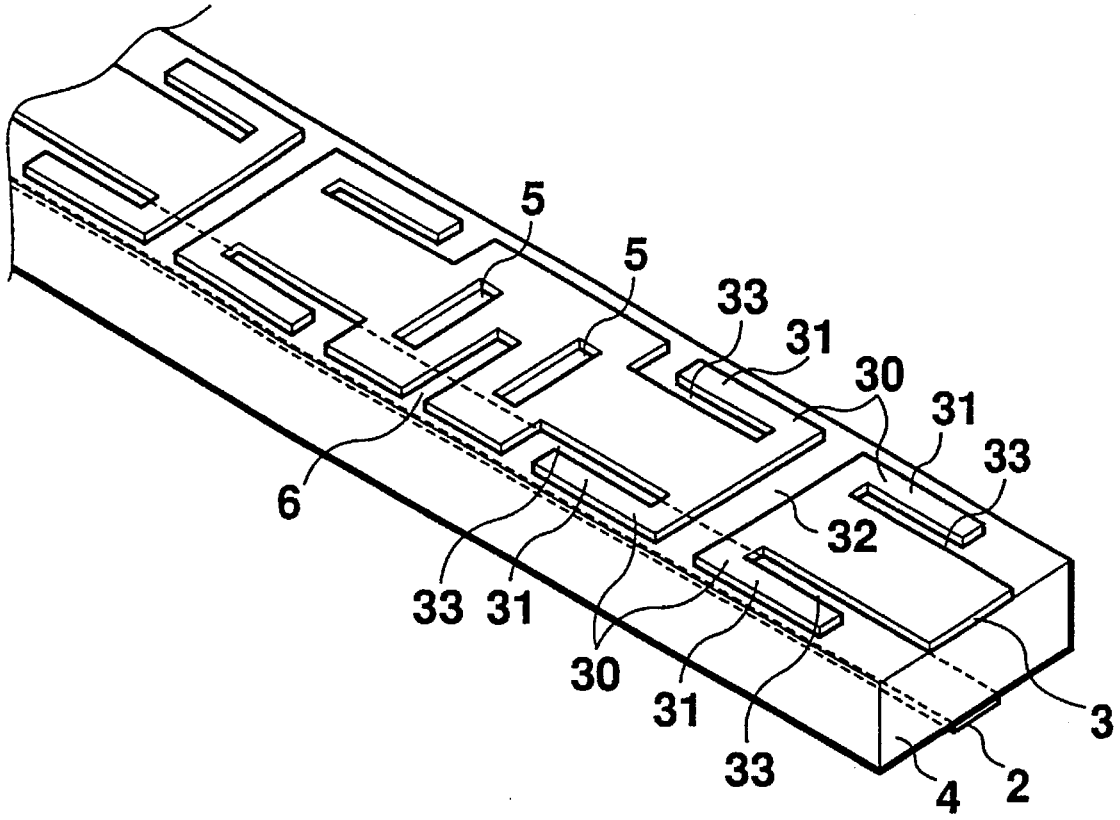
FIG. 12 is a perspective view of an antenna apparatus according to an eleventh embodiment of the invention.

FIG. 12 is a perspective view showing an antenna apparatus according to an eleventh embodiment of the invention. In FIG. 12, parts or elements similar to those of the tenth embodiment are designated by the same reference numerals.

The operation of the antenna apparatus of the eleventh embodiment will now be described. In this antenna apparatus, the dipoles 30 are arranged in multiple steps via the slits 32 longitudinally of the microstrip line, being located in a common plane with the earth conductor 3 of the microstrip line. The earth conductor 3 between the dipoles 30 has slots 5 and cutouts 6 as delay wave openings. The operation principles of this antenna are similar to those of the first and seventh embodiment. The advantage of this invention is as follows. Since the dipoles 30 serving as antenna elements and the delay wave openings in the form of the slots 5 and cutouts 6 are located in a common plane with the earth conductor 3, the antenna is low in height. Further, it is possible to form the conductors on the dielectric substrate 4 in one and the same etching process, and the antenna is simple in structure and hence is suitable for mass manufacturing. In the absence of the slots 5 and the cutouts 6, the phase of array excitation of the dipoles 30 is determined by the length of the microstrip line. According to the eleventh embodiment, since an arbitrary delay wave characteristic of the same microstrip line length is obtained using the delay wave openings in the form of the slots 5 and cutouts 6, the dipoles 30 can be arranged at arbitrary array distances while keeping a desired excitation phase value. In this case, it is possible to set up the dipoles 30 to an optimum value to be determined from the effective opening area of the antenna, irrespective of the length of the feed line.

According to the eleventh embodiment, power is supplied to a number of divided antenna elements from the microstrip line. The microstrip line acts as a common transmission line with the antenna elements. The earth conductor 3 not to be regarded as part of the antenna elements have the delay wave openings each in the form of the slot 5 and the cutout 6 opening at one end. The dipoles 30 are located in a common plane with the earth conductor 3 of the microstrip line, and each dipole 30 is constituted by a pair of conductors of approximately ¼ wavelength and is energized via the slit 32, which is very small compared to the wavelength and divides the earth conductor 3 into two electrically non-contact portions. With this arrangement, it is possible to obtain a desired phase of excitation of the antenna elements because of the delay wave openings without varying the distance between the antenna elements so that a small-height power-circuit-unitary antenna having a desired radiation directivity can be realized.

This embodiment has the advantages of the first and seventh embodiments in combination, with no risk of canceling each other's advantage. The antenna elements may have alternative shapes of the eighth and ninth embodiments as required.

Figure 13:
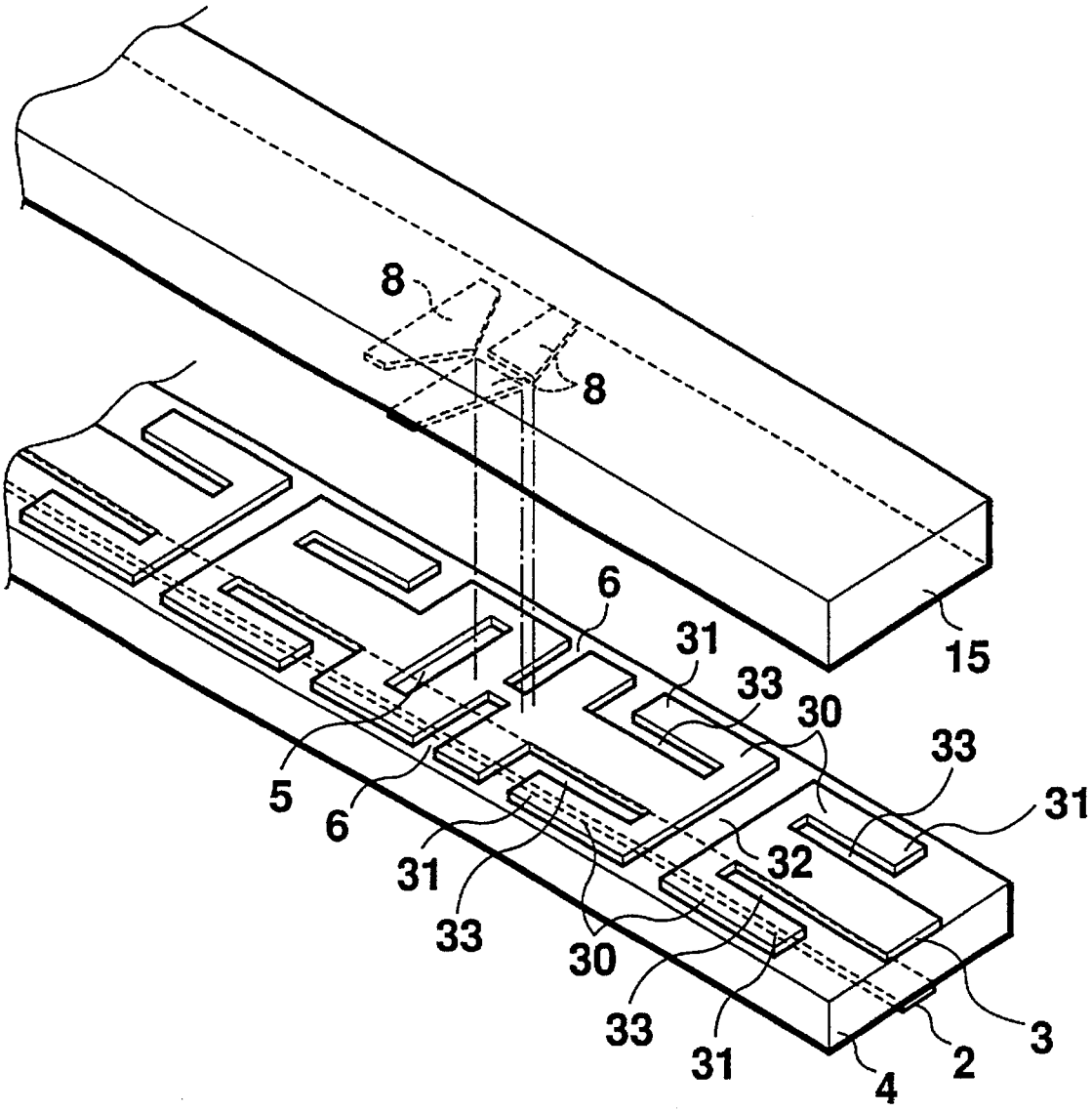
FIG. 13 is an exploded perspective view of an antenna part of an antenna apparatus according to a twelfth embodiment of the invention.

FIG. 13 is a perspective view showing an antenna apparatus according to a twelfth embodiment of the invention. In FIG. 13, parts or elements similar to those of the eleventh embodiment are designated by the same reference numerals.

The operation of the antenna apparatus of the twelfth embodiment will now be described. In this embodiment, in order to vary the amount of phase shift of the delay wave openings in the form of slots 5 and cutouts 6, there is proved a dielectric support plate 15 carrying masking conductors and substantially equal in shape to a dielectric substrate 4. With this arrangement, an antenna apparatus having the advantageous features of the second, seventh and tenth embodiments in combination can be realized; this is, an improved antenna apparatus in which the radiation pattern is symmetrical and can be varied and in which various elements are formed compactly within the feed line. The antenna may be supported by the mechanism described in connection with the third embodiment. The antenna elements may have alternative shapes of the eighth and ninth embodiments.

According to the twelfth embodiment, the dielectric support plate 15 carrying the regulating conductors 8 for covering the delay wave openings in the form of the slots 5 and cutouts 6 is superposed over the earth conductor 3 of the microstrip line, each support plate 15 being substantially equal in dielectric constant, thickness and width to the dielectric substrate 4 on which the microstrip line 2, 3 and the dipoles 30 are mounted. Thus an antenna apparatus results in which a number of radiation patterns can be formed, each in neat symmetry, and which is small in height.

Figure 14A:
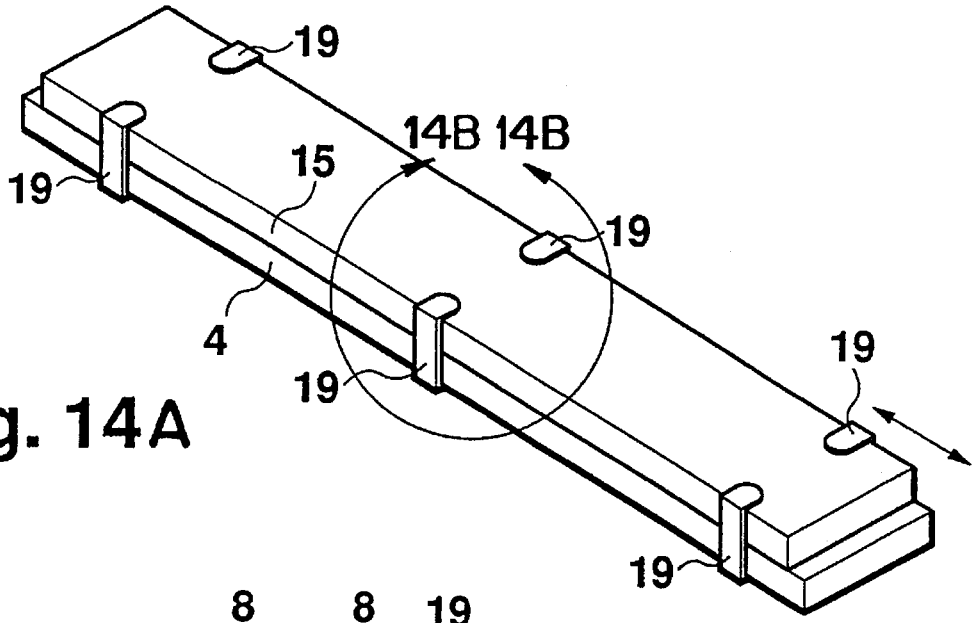
FIG. 14 is a perspective view of the whole antenna apparatus of the twelfth embodiment.
Figure 14B:
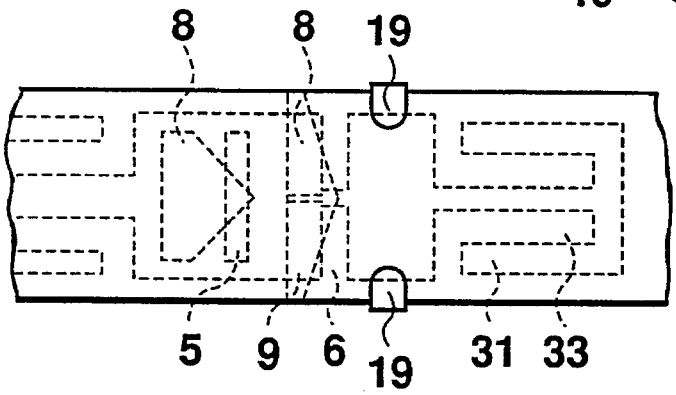

FIG. 14 is a perspective view showing the whole structure of the twelfth embodiment. In FIG. 14, parts or elements substantially similar to those of FIG. 13 are designated by similar reference numerals.

The operation of the antenna apparatus of the twelfth embodiment. In the structure of the twelfth embodiment as the antenna elements, the dielectric substrate 4 and the dielectric support plate 15 are supported by the dielectric clips 19 in such a manner that they are continuously moved relative to each other. The moving mechanism may be of the type described in connection with the fourth embodiment. With this arrangement, the antenna apparatus has the advantageous features of the fourth and seventh embodiments in combination; this is, an antenna apparatus in which various elements are formed compactly in the feed line and the radiation pattern can be varied continuously. The antenna is supported by the mechanism described in connection with the third embodiment. The antenna elements may have alternative shapes of the eighth and ninth embodiments. In order to improve the symmetry of the radiation pattern, the structure of the tenth embodiment may be used. Further, the whole antenna may accommodated in the dielectric casing, and the moving mechanism of the sixth embodiment may be used.

According to this embodiment, the dielectric support plate 15 carrying the dielectric regulating plates 8 for covering the delay wave structure in the form of the slots 5 and cutouts 6 is substantially equal in dielectric constant, thickness and width to the substrate 4.

Figure 15:
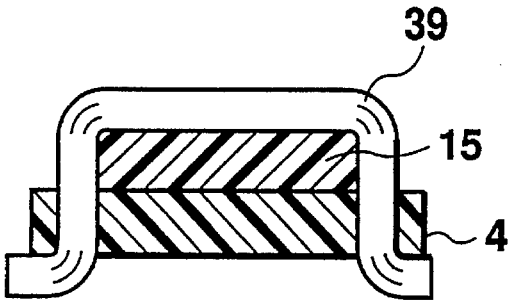
FIG. 15 is a cross-sectional view of an antenna apparatus according to a thirteenth embodiment of the invention.

FIG. 15 shows an antenna apparatus according to a thirteenth embodiment of the invention, illustrating a structure for bringing the dielectric substrate 4 and the regulating support plate 15 into sliding intimate contact with each other. In FIG. 15, metal wires, instead of the clips 19, such as wires 39 of soldering plating copper are secured to the substrate 4. Other parts or elements similar to those of the first to thirteenth embodiments are designated by similar reference numerals.

The operation of the antenna apparatus of the thirteenth embodiment will now be described. In the antenna structure of the twelfth embodiment, the dielectric substrate 4 and the dielectric support plate 15 are pressed against each other using metal wires 39 extending through holes formed in the dielectric substrate 4 at positions influence-free electrically (positions other than the earth conductor of the microstrip line), and the dielectric support plate 15 is slidable longitudinally on the dielectric substrate 4. The moving mechanism may be of the type described in connection with the fourth embodiment. The antenna apparatus has the advantageous features of the fourth and seventh embodiments in combination; this is, an antenna apparatus in which the radiation pattern can be varied continuously and in which various elements can be formed compactly in the feed line can be obtained. The antenna may be supported by the mechanism described in connection with the third embodiment. The antenna elements may have alternative shapes of the eighth and ninth embodiments. In order to improve the symmetry of the radiation pattern, the structure of the tenth embodiment may be used. Further, the whole antenna may be accommodated in the dielectric casing, and the moving mechanism of the sixth embodiment may be used.

According to the loose attachment between the substrate 4 and the support plate 15 using the wires 39, the support mechanism is resistant against vibration and displacement, and an antenna apparatus having a stable electrical characteristic can be realized.

Figure 16:
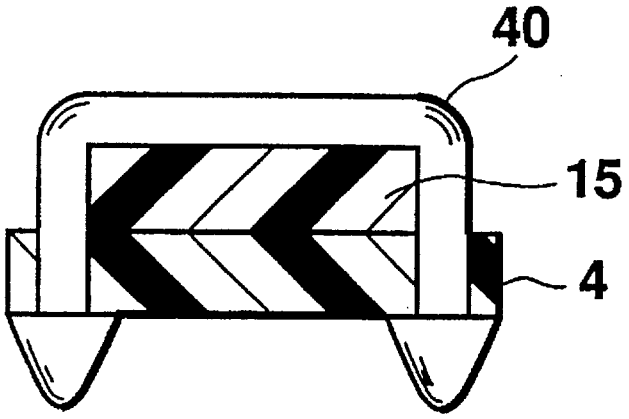
FIG. 16 is a cross-sectional view of an antenna apparatus according to a fourteenth embodiment of the invention.

FIG. 16 shows an antenna apparatus according to a fourteenth embodiment of the invention, in which a clamp instead of the wires of the thirteenth embodiment is used. In FIG. 16, reference numeral 40 designates a clamp made of a dielectric material, and parts or elements similar to those of the first to thirteenth embodiments are designated by similar reference numerals.

The operation of the antenna apparatus of the fourteenth embodiment will now be described. In the antenna structure of the twelfth embodiment, the dielectric substrate 4 and the dielectric support plate 15 are pressed against each other using the dielectric clamp 40 in such a manner that the dieletric support plate 15 is slidable longitudinally on the dielectric substrate. The moving mechanism may be of the type described in connection with the fourth embodiment. The antenna apparatus has the advantageous features of the fourth and seventh embodiments in combination; this is, an antenna apparatus in which the radiation pattern can be varied continuously and various elements formed campactly in the feed line can be obtained. The antenna may be supported by the mechanism described in connection with the third embodiment. The antenna elements may have alternative shapes of the eighth and ninth embodiments. In order to improve the symmetry of the radiation pattern, the structure of the tenth embodiment may be used. The whole antenna may be accommodated in the dielectric casing, and the moving mechanism of the sixth embodiment may be used.

Accoding to this embodiment, since the substrate 4 and the support plate 15 are loosely secured by the clamp 40, the support mechanism is resistant against vibration and displacement, and an antenna apparatus having a stable electrical characteristic can be realized.

Figure 17:
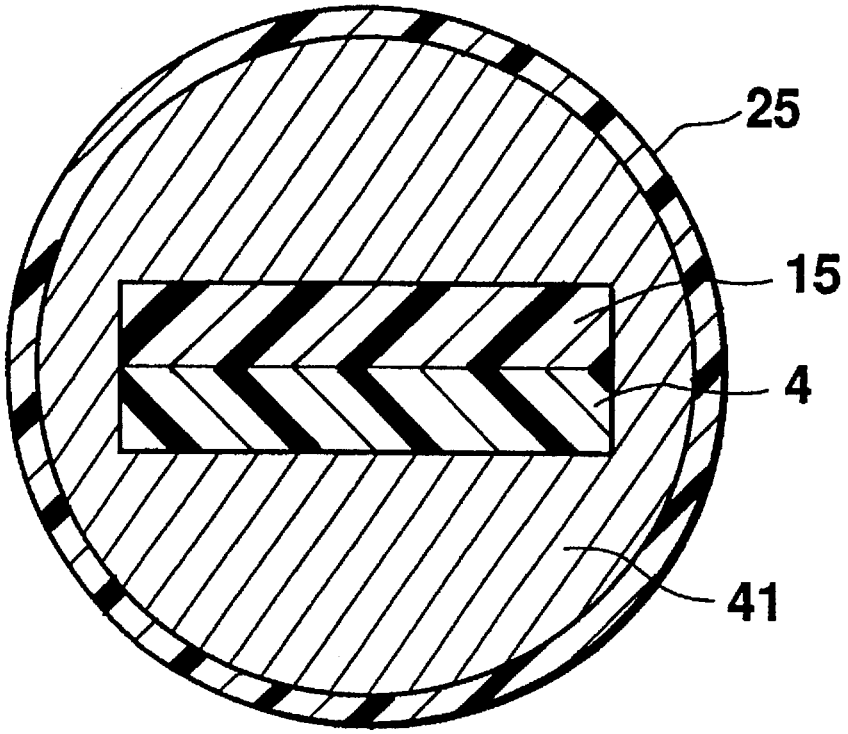
FIG. 17 is a cross-sectional view of an antenna apparatus according to a fifteenth embodiment of the invention.

FIG. 17 shows an antenna apparatus according to a fifteenth embodiment of the invention. In FIG. 17, a cylindrical casing 25 of circular cross section is filled with a foamed material 41, and parts or elements similar to those of the first to fourth embodiments are designated by the same reference numerals.

The operation of the antenna apparatus of the fifteenth embodiment will now be described. In the antenna structure of the twelfth embodiment, the dielectric substrate 4 and the dielectric support plate 15 are supported in the dielectric casing 25 by the foamed material 41 between the dielectric substrate 4 and the casing 25 and between the latter and the dielectric support plate 15, the foamed material 41 having an dielectric constant substantially equal to that of air. The circular cross section of the dielectric casing 25 serves to cause a constant wind load when the antenna installed outside receives any wind in any direction. The dielectric support plate 15 is slidable longitudinally on the dielectric substrate 4. The moving mechanism may be of the type described in connection with the fourth embodiment. The antenna apparatus may have the advantageous features of the fourth and seventh embodiments in combination; this is, an antenna apparatus in which the radiation pattern can be varied continuously and various elements formed compactly in the feed line can be realized. The antenna may be supported by the structure of the third embodiment. The antenna elements may have alternative shapes of the eighth and ninth embodiments. In order to improve the symmetry of the radiation pattern, the structure of the tenth embodiment may be used. The whole antenna may be accommodated in the dielectric casing, and the moving mechanism of the sixth embodiment may be used.

According to this embodiment, partly since the substrate 4 and the support plate 15 are substantially equal in dielectric constant, thickness and width to each other, and partly since they are embedded in the casing 25 filled with a foamed material which scarcely tends to be damaged from an electrical characteristic view point, the support mechanism is resistant against vibration and displacement so that an antenna apparatus having a stable electrical characteristic can be realized.

Figure 18:
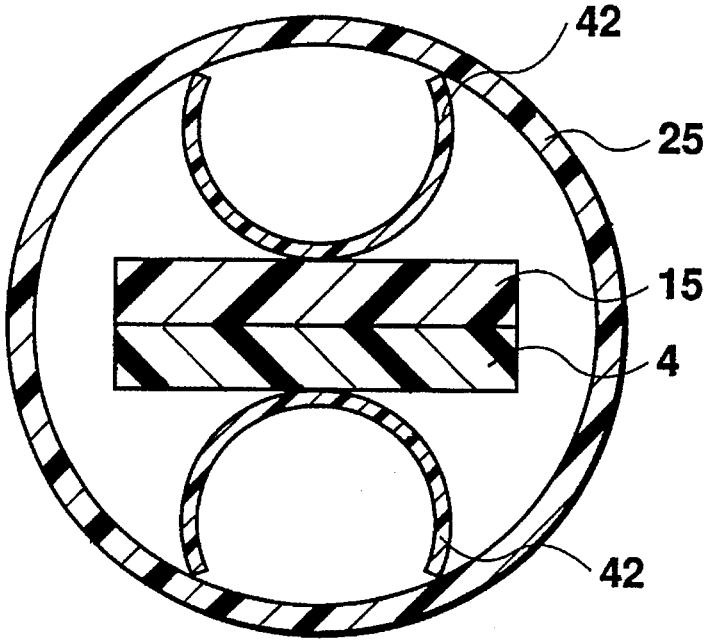
FIG. 18 is a cross-sectional view of an antenna apparatus according to a sixteenth embodiment of the invention.

FIG. 18 shows an antenna apparatus according to a sixteenth embodiment of the invention, illustrating an improvement of the antenna support mechanism in the casing 25. In FIG. 18, reference numeral 42 designates C rings made of a dielectric material, and parts or elements similar to those of the first to fifteenth embodiments are designated by the same reference numerals.

The operation of the antenna apparatus of the sixteenth embodiment will now be described. In the antenna structure of the twelfth embodiment, the two dielectric and springy C rings 42 are situated respectively between the dielectric substrate 4 and the dielectric casing 25 and between the latter and the dielectric support plate 15 in such a manner that the dielectric support plate 15 is slidable longitudinally on the dielectric substrate 4. The moving mechanism may be of the type described in connection with the fourth embodiment. The antenna apparatus may have the advantageous features of the fourth and seventh embodiments; this is, an antenna apparatus in which the radiation pattern can be varied continuously and various elements formed compactly in the feed line can be realized. The antenna may be supported by the mechanism described in connection with the third embodiment. The antenna elements may have alternative shapes of the eighth and ninth embodiments. In order to improve the symmetry of the radiation pattern, the structure of the tenth embodiment may be used.

According to this embodiment, since the dielectric substrate 4 and the dielectric support plate 15, which are substantially equal in dielectric constant, thickness and width to each other, are superposed over each other and supported in the casing 25 by the C rings 42 which scarcely tend to be damaged from an electrical characteristic view point, the support mechanism is resistant against vibration and displacement so that an antenna apparatus having a stable electrical characteristic can be obtained.

Figure 19:
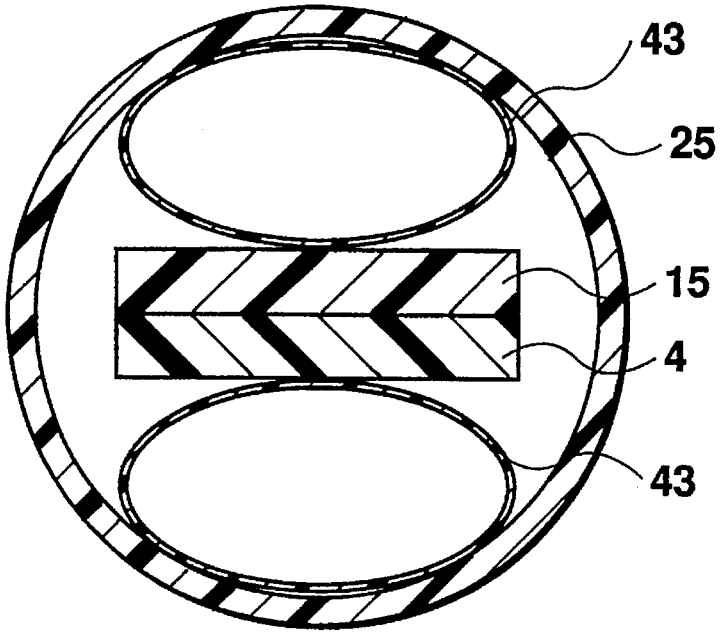
FIG. 19 is a cross-sectional view of an antenna apparatus according to a seventeenth embodiment of the invention.

FIG. 19 shows an antenna apparatus according to a seventeenth embodiment of the invention, illustrating another improvement of the antenna support mechanism in the casing. In FIG. 19, reference numeral 43 designates pipes which are made of a dielectric material and has an oval cross section, and parts or elements similar to those of the first to sixteenth embodiments are designated by similar reference numerals.

The operation of the antenna apparatus of the seventeenth embodiment will now be described. In the antenna structure of the twelfth embodiment, the dielectric oval pipes 43 having an oval cross section are inserted respectively between the dielectric substrate 4 and the dielectric casing 25 and between the latter and the dielectric support plate 15, supporting the substrate 4 and the support plate 15 in the casing 25 in such a manner that the dielectric support plate 15 is slidable longitudinally on the dielectric substrate 4. The moving mechanism may be of the type described in connection with the fourth embodiment. The antenna apparatus may have the advantageous features of the fourth and seventh embodiments; this is, an antenna apparatus in which the radiation pattern can be varied continuously and various elements formed compactly in the feed line can be realized. The antenna may be supported by the mechanism described in connection with the third embodiment. The antenna elements may have alternative shapes of the eighth and ninth embodiments. In order to improve the symmetry of the radiation pattern, the structure of the tenth embodiment may be used.

According to this embodiment, since the dielectric substrate 4 and the dielectric support plate 15, which are substantially equal in dielectric constant, thickness and width to each other, are superposed over each other and supported in the casing 25 by the pipes 43 which have an oval cross section and scarcely tend to be damaged from an electrical characteristic view point, the support mechanism is resistant against vibration and displacement so that an antenna apparatus having a stable electrical characteristic can be obtained.

Figure 20:
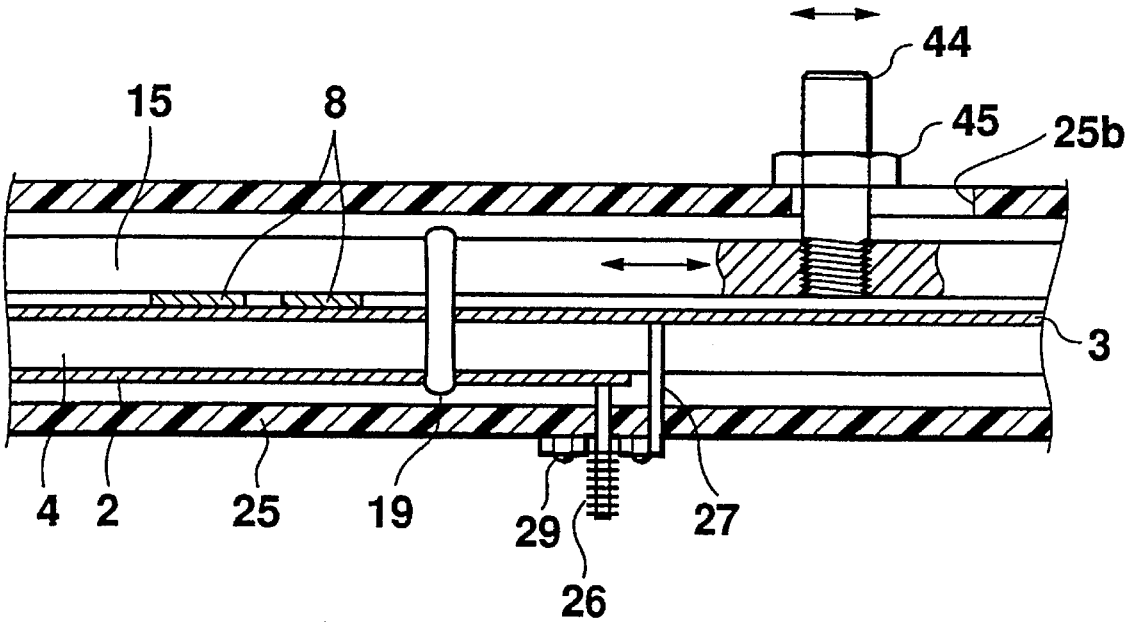
FIG. 20 is a cross-sectional view of an antenna apparatus according to an eighteenth embodiment of the invention.

FIG. 20 shows an antenna apparatus according to an eighteenth embodiment of the Invention, illustrating an improvement of the sixth embodiment. In FIG. 20, a screw bolt 44 is secured to part of the dielectric regulating support plate 15, projecting out of the casing 25 from an elongate hole 25*b*. Using the screw bolt 44 from outside, it is possible to adjust in the direction of an arrow with respect to the substrate 4 fixed to the casing 25. If a nut 45 is threadedly mounted on the screw bolt 44 outside the casing 25, it is possible to prevent the screw bolt 44 from tilting.

The operation of the antenna apparatus of the eighteenth embodiment will now be described. The operation of the electrical system of the antenna apparatus is similar to that of the fifth embodiment. Conventionally, in order to improve the goodness of fit to the environment of the antenna installation, it has been customary to accommodate the antenna in the casing. So in this embodiment, the antenna of FIG. 5 is mounted in the dielectric casing 25. A power supply connector 26 is provided to supply power to the antenna; a core of the connector is connected to the upper conductor 2 of the microstrip line while an outer conductor of the connector is connected to the earth conductor 3 of the microstrip line via a short-circuit cable 27. Power is supplied to the antenna from the connector 26, and the angle of tilt of the antenna beam is adjusted by sliding the screw bolt 44. The nut 45 serves to prevent the screw bolt 45 from tilting. As the advantage of this arrangement, it is possible to adjust the beam tilt angle after the antenna has been installed, so that the orientation of the antenna can be changed without any laborious work such as moving and disassembling the antenna.

According to this embodiment, in order to continuously vary the effective shape of the delay wave opening in the earth conductor 3, there is provided a mechanism for moving the support plate 15 in parallel to the earth conductor 3. Thus the delay wave opening can be used as a phase shifter for varying the phase continuously. Since the phase of excitation of the antenna can be varied continuously to a desired value, it is possible to obtain an antenna apparatus which can change the shape of the radiation pattern continuously.

Figure 21:
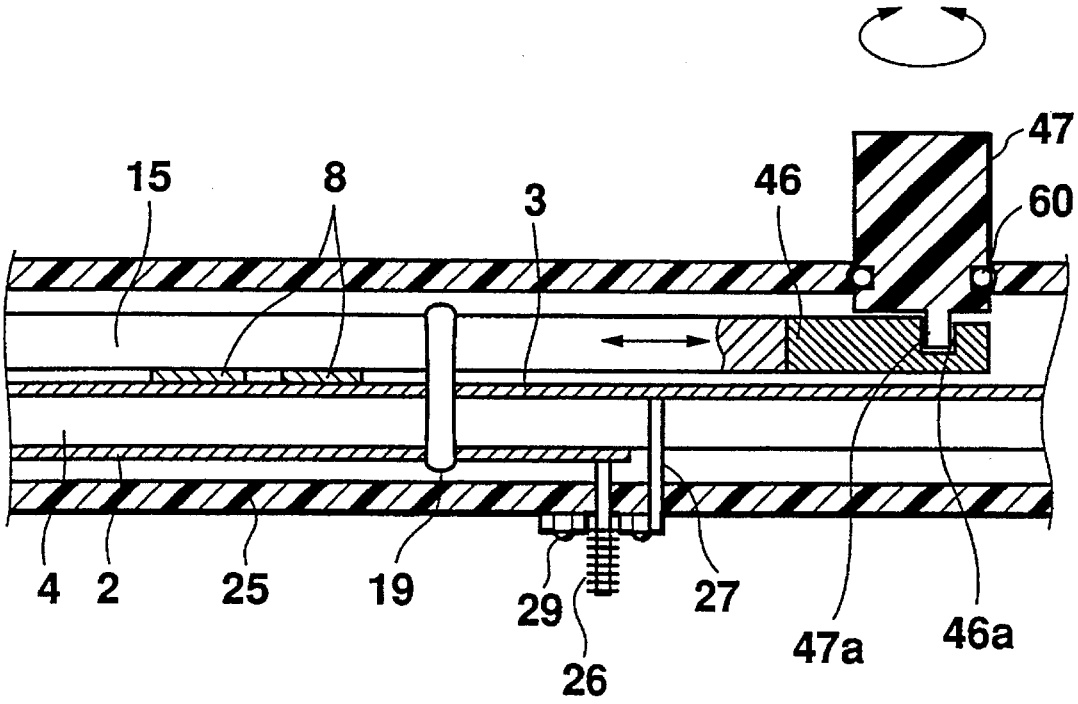
FIG. 21 is a cross-sectional view of an antenna apparatus according to a nineteenth embodiment of the invention.

FIG. 21 shows an antenna apparatus according to a nineteenth embodiment of the invention, illustrating another improvement of the moving mechanism for moving the support plate with respect to the substrate in the casing. In FIG. 21, the regulating support plate 15 has on one end a pushing plate 46 having a groove 46*a*, while an adjusting disc 47 is rotatably supported by the casing 25 via an O ring 60 and has a projection 47*a* engaged in the groove 46*a*.

The operation of the antenna apparatus of the nineteenth embodiment will now be described. When the adjusting disc 47 is turned, the pushing plate 46 will be moved horizontally as the projection of the disc 47 is fitted in the groove 46*a* of the support plate 46, bringing the dielectric plate 15 with the masking conductors horizontally. The disc 47 is fixedly held by the friction between the O ring 60 and the dielectric casing 25. The advantage of this embodiment is that the beam tilt angle can be adjusted after the antenna has been installed and that the antenna orientation can be varied without any laborious work such as removing and disassembling the antenna.

According to this embodiment, in order to continuously vary the effective shape of the delay wave opening in the earth conductor 3, there is provided a mechanism for moving the support plate 15 in parallel to the earth conductor 3. Thus the delay wave opening can be used as a phase shifter for varying the phase continuously. Since the phase of excitation of the antenna can be varied continuously to a desired value, it is possible to obtain an antenna apparatus which can change the shape of the radiation pattern continuously.

Figure 22:
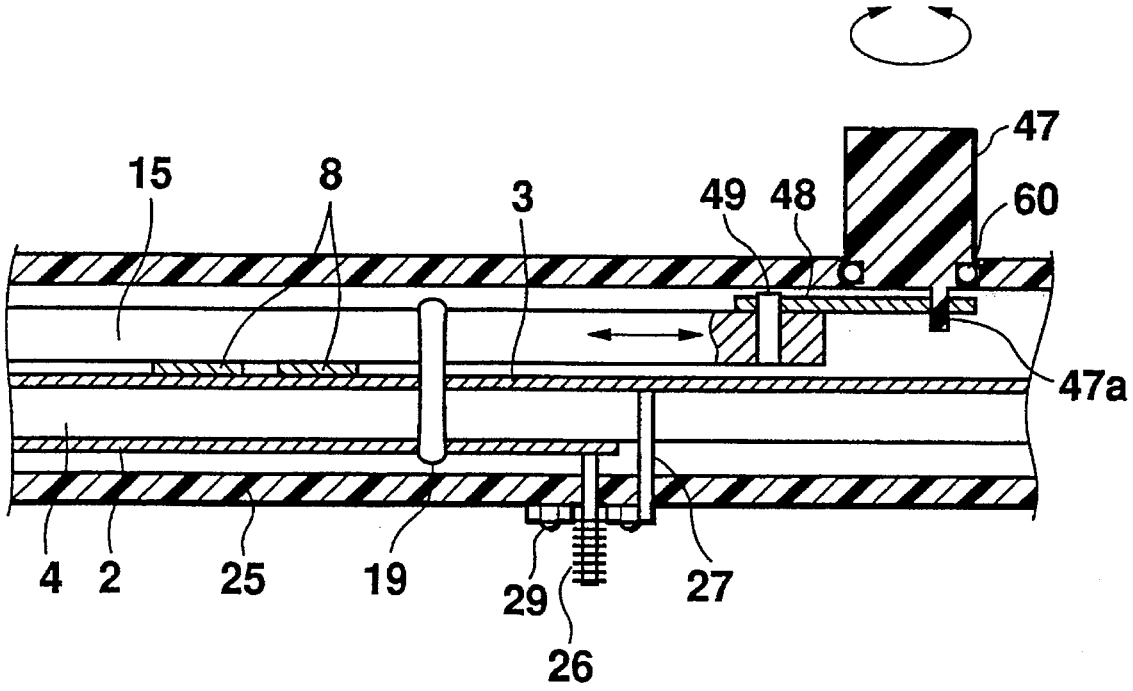
FIG. 22 is a cross-sectional view of an antenna apparatus according to a twentieth embodiment of the invention.

FIG. 22 shows an antenna apparatus according to a twentieth embodiment of the invention, illustrating an improvement of the nineteenth embodiment. In FIG. 22, a connecting rod 48 is pivotally connected at one end to the projection 47*a* of the adjusting disc 47 and is supported at the other end by a pin 49 mounted on the support plate 15.

The operation of the antenna apparatus of the twentieth embodiment will now be described. Since the adjusting disc 47 and the dielectric support plate 15 are connected with each other via the connecting rod 48 and the pin 49, it is possible to realize moving of the dielectric support plate 15 horizontally according to the principle of the crank mechanism as the disc 47 is rotated. The advantage of this embodiment is that the beam tilt angle can be adjusted after the antenna has been installed and that the antenna orientation can be varied without any laborious work such as removing and disassembling the antenna.

According to this embodiment, in order to continuously vary the effective shape of the delay wave opening in the earth conductor 3, there is provided a mechanism for moving the support plate 15 in parallel to the earth conductor 3. Thus the delay wave opening can be used as a phase shifter for varying the phase continuously. Since the phase of excitation of the antenna can be varied continuously to a desired value, it is possible to obtain an antenna apparatus which can change the shape of the radiation pattern continuously.

Figure 23:
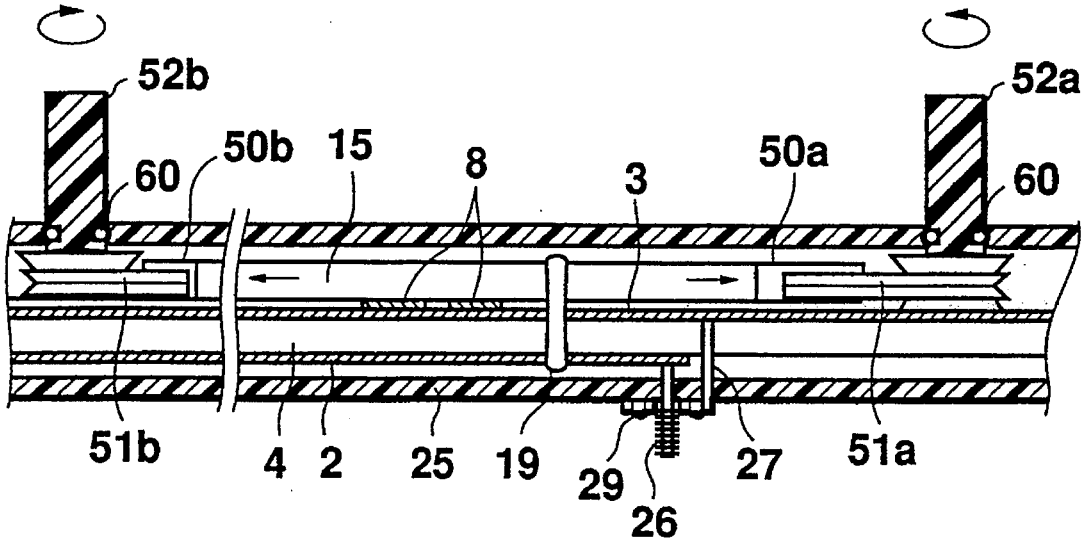
FIG. 23 is a cross-sectional view of an antenna apparatus according to a twenty-first embodiment of the invention.

FIG. 23 shows an antenna apparatus according to a twenty-first embodiment of the invention, illustrating a belt-and-pulley mechanism for moving the support plate with respect to the substrate in the casing. In FIG. 23, two belt receiving plate 50*a*, 50*b* are fixed respectively to opposite ends of the support plate 15, while two pulley shafts 52*a*, 52*b* on which respective pulleys are mounted are rotatably supported on the upper surface of the casing 25 via O rings 60. Two V belts 51*a*, 51*b* are wound around the respective pulleys and are fixed at opposite ends to the belt receiving plates 50*a*, 50*b*.

The operation of the antenna apparatus of the twenty-first embodiment will now be described. As the shaft 52 fixed to the pulley on the right end of the antenna is rotated, the belt receiving plates 50*a* on which the V belt 51*a* is wound will be moved to the right, bringing the dielectric support plate 15 carrying the masking conductors in the same direction. To return the support plate 15 to the original position, the pulley 52*b* at the left end of the antenna is used. The advantage of this embodiment is that the beam tilt angle can be adjusted after the antenna has been installed and that the antenna orientation can be varied without any laborious work such as removing and disassembling the antenna.

According to this embodiment, in order to continuously vary the effective shape of the delay wave opening in the earth conductor 3, there is provided a mechanism for moving the support plate 15 in parallel to the earth conductor 3. Thus the delay wave opening can be used as a phase shifter for varying the phase continuously. Since the phase of excitation of the antenna can be varied continuously to a desired value, it is possible to obtain an antenna apparatus which can change the shape of the radiation pattern continuously.

Figure 24:
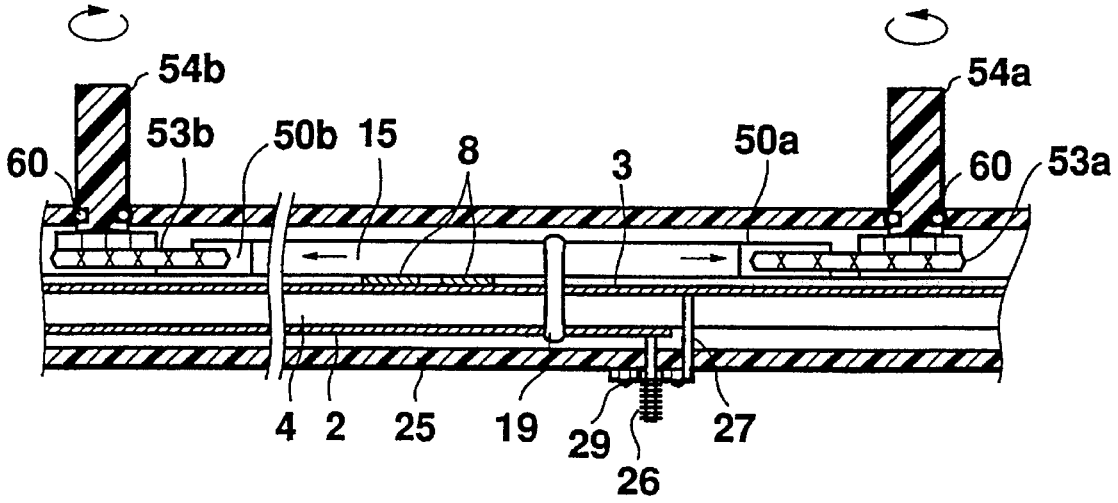
FIG. 24 is a cross-sectional view of an antenna apparatus according to a twenty-second embodiment of the invention.

FIG. 24 shows an antenna apparatus according to a twenty-second embodiment of the invention, illustrating a chain mechanism substituted for the belt-and-pulley mechanism of the twenty-first embodiment. In FIG. 24, reference numerals 53*a*, 53*b* designate chains attached to opposite ends of a support plate 15 of a dielectric less influential on the electric field, and 54*a*, 54*b* designate shafts on which respective gears are mounted.

The operation of the antenna apparatus of the twenty-second embodiment will now be described. The operation of the electrical system of this antenna apparatus is similar to the fifth embodiment. As the shaft 54*a* having a gear is rotated, the chain 53*a* will be wound up to move the receiving plate 50*a* to the right, bringing the dielectric support plate 15 with the masking conductors in the same direction. To return the support plate 15 to the original position, the gear at the left end of the antenna is used. The advantage of this embodiment is that the beam tilt angle can be adjusted after the antenna has been installed and that the antenna orientation can be varied without any laborious work such as removing and disassembling the antenna.

According to this embodiment, in order to continuously vary the effective shape of the delay wave opening in the earth conductor 3, there is provided a mechanism for moving the support plate 15 in parallel to the earth conductor 3. Thus the delay wave opening can be used as a phase shifter for varying the phase continuously. Since the phase of excitation of the antenna can be varied continuously to a desired value, it is possible to obtain an antenna apparatus which can change the shape of the radiation pattern continuously.

Figure 25:
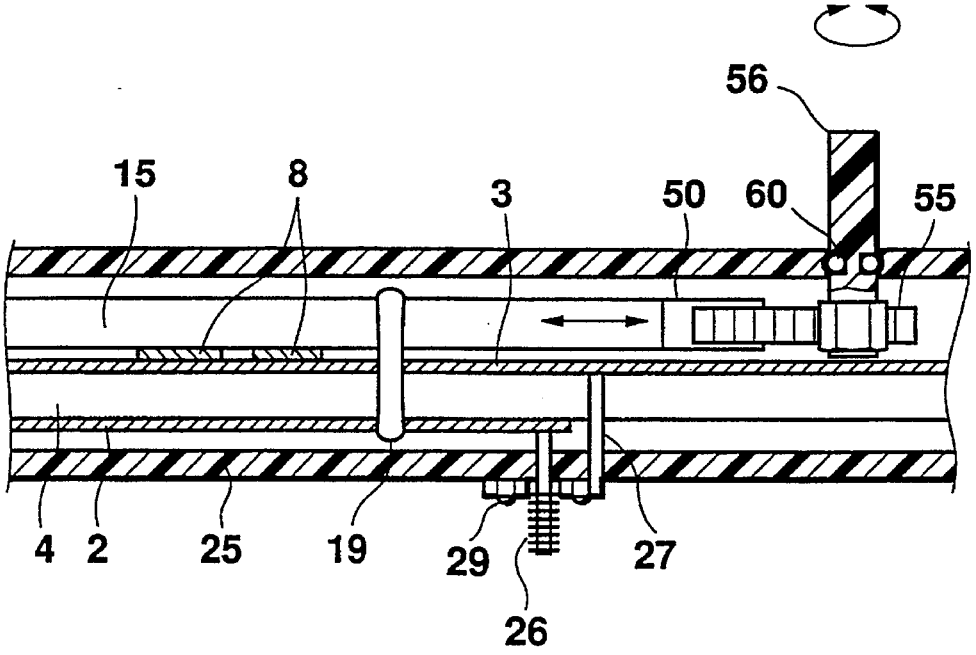
FIG. 25 is a cross-sectional view of an antenna apparatus according to a twenty-third embodiment of the invention.

FIG. 25 shows an antenna apparatus according to a twenty-third embodiment of the invention, illustrating a rack-and-pinion mechanism for moving the support plate. In FIG. 25, reference numeral 55 designates a rack mounted on one end of a support plate 15 of a dielectric less influential on electric field, and 56 designates a shaft having a pinion. Parts or elements similar to those of the sixth and twentieth embodiments are designated by similar reference numerals.

The operation of the antenna apparatus of the twenty-third embodiment will now be described. As the shaft 56 having a pinion is rotated, the receiving plate 50 is moved horizontally via the rack 55, bringing the dielectric support plate 15 with the masking conductors in the same direction. The advantage of this embodiment is that the beam tilt angle can be adjusted after the antenna has been installed and that the antenna orientation can be varied without any laborious work such as removing and disassembling the antenna.

According to this embodiment, in order to continuously vary the effective shape of the delay wave opening in the earth conductor 3, there is provided a mechanism for moving the support plate 15 in parallel to the earth conductor 3. Thus the delay wave opening can be used as a phase shifter for varying the phase continuously. Since the phase of excitation of the antenna can be varied continuously to a desired value, it is possible to obtain an antenna apparatus which can change the shape of the radiation pattern continuously.

Figure 26:
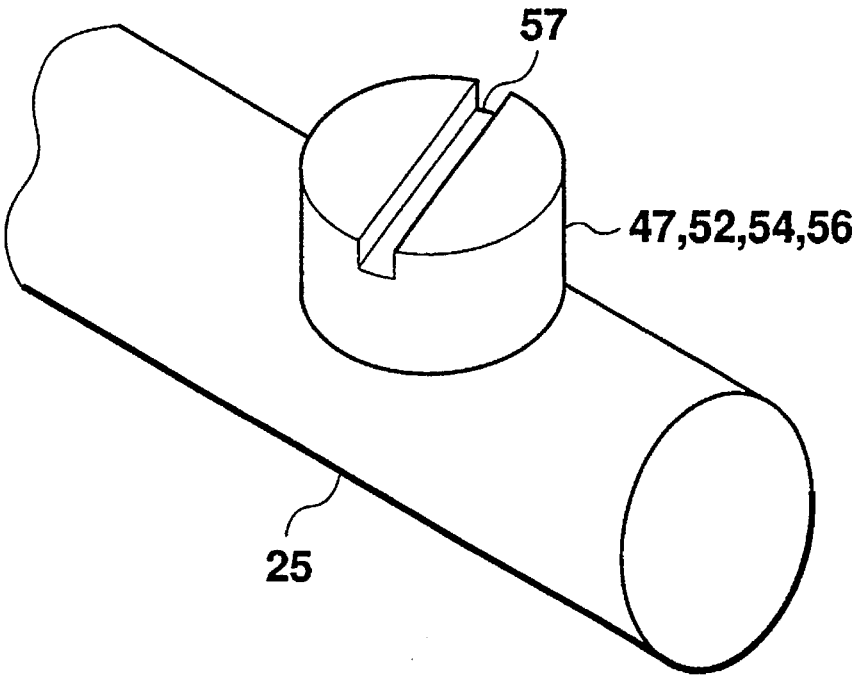
FIG. 26 is a perspective view showing a modification of a support plate moving mechanism of the invention.

FIG. 26 is a perspective view of a shaft 47, 52, 54, 56 to be used in the twentieth to twenty-fourth embodiments, the shaft having a groove 57.

Figure 27:
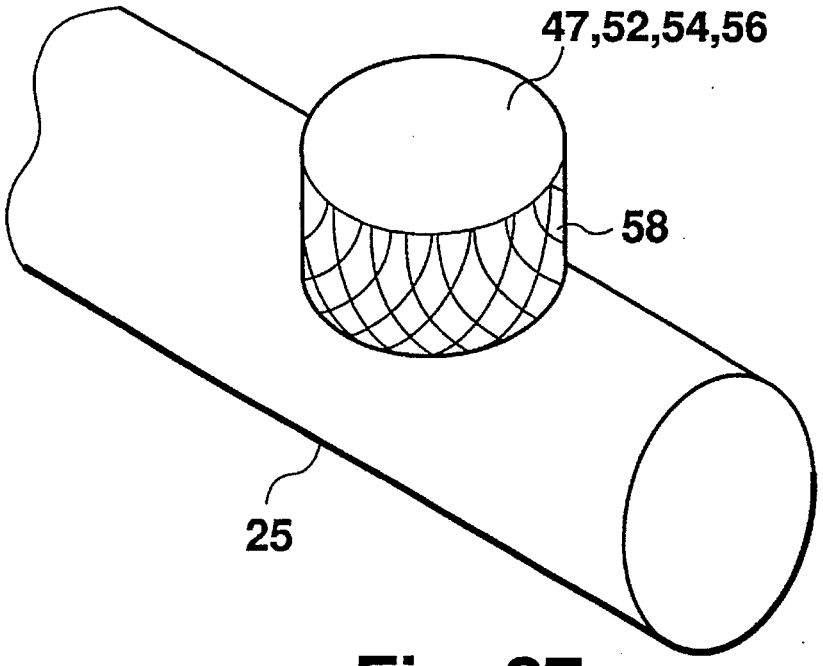
FIG. 27 is a perspective view showing another modification of the support plate moving mechanism.

FIG. 27 is a perspective view of an alternative shaft 47, 52, 54, 56 having a knurled circumferential surface 58.

Figure 28:
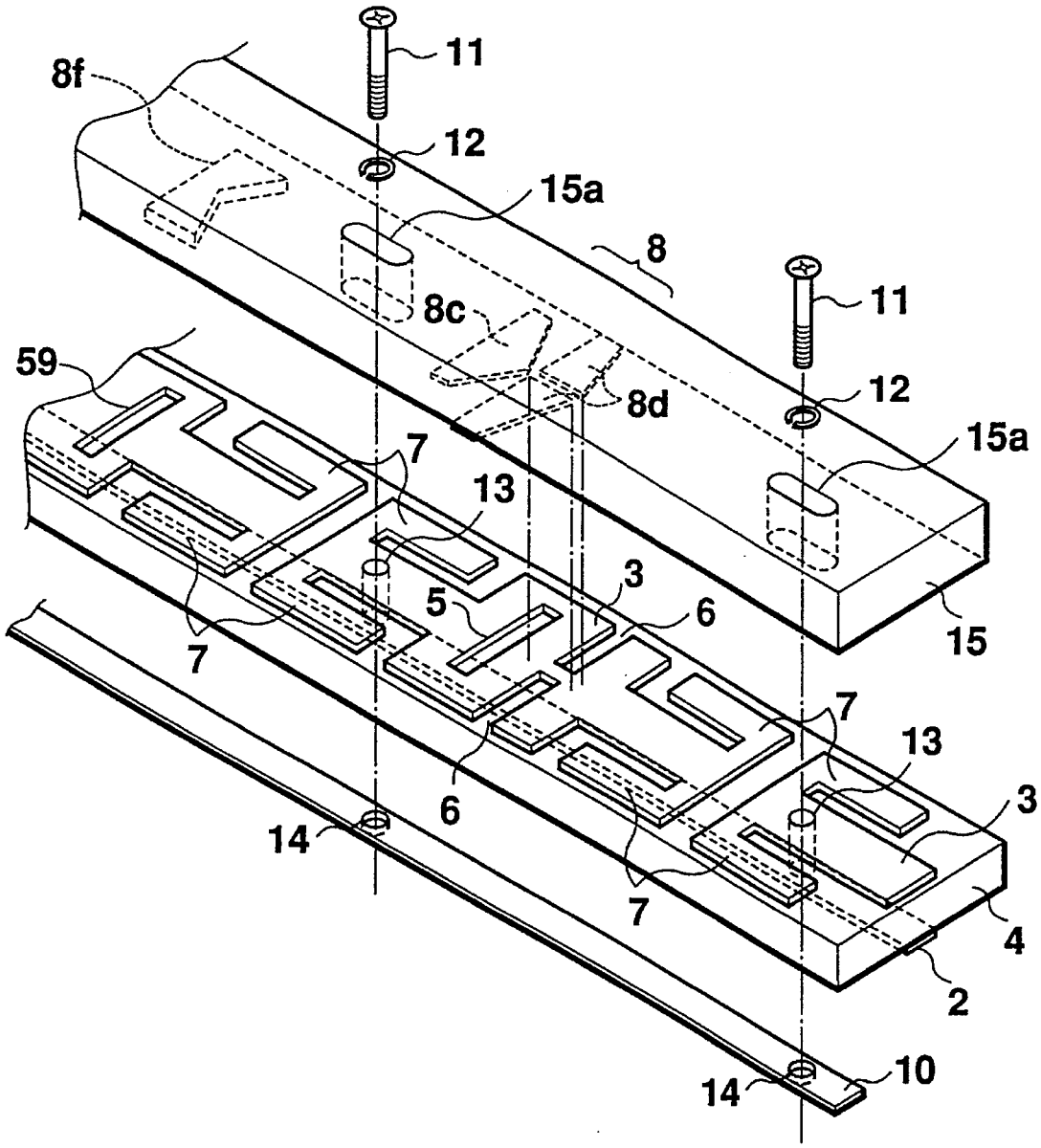
FIG. 28 is a perspective view of an antenna apparatus according to a twenty-fourth embodiment of the invention.
Figure 29:
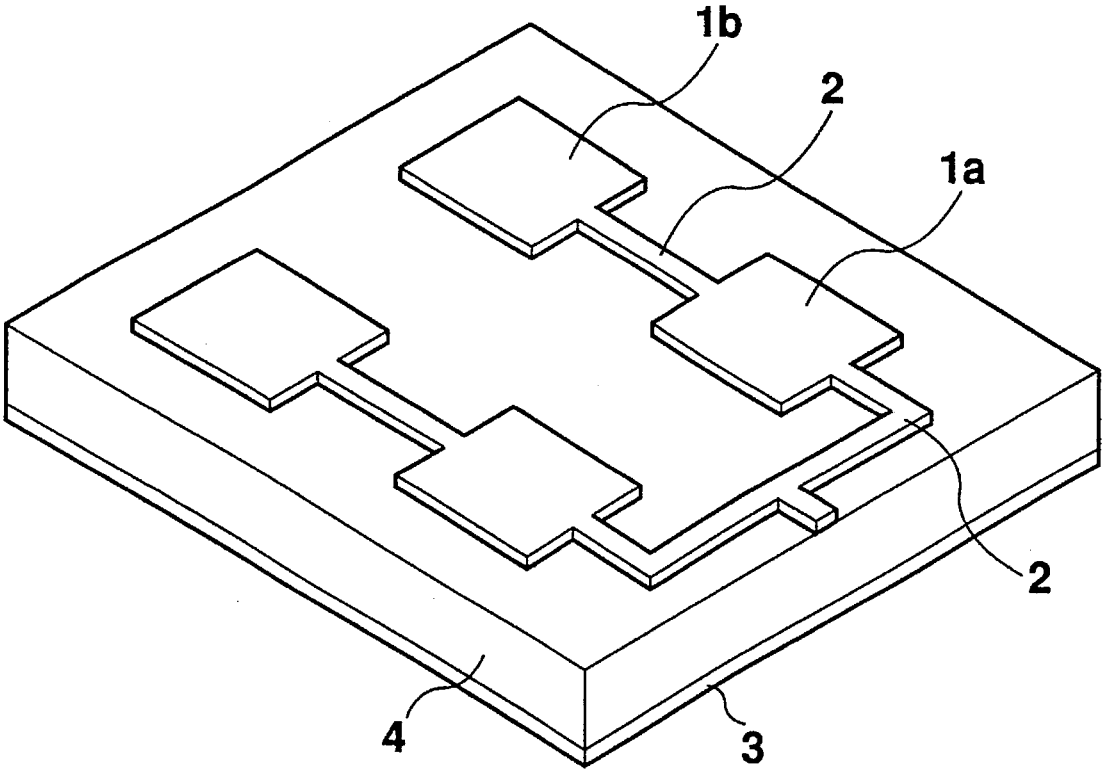
Fig. 29 PRIOR ART
FIG. 29 is a perspective view of a conventional microstrip antenna apparatus.
Figure 30:
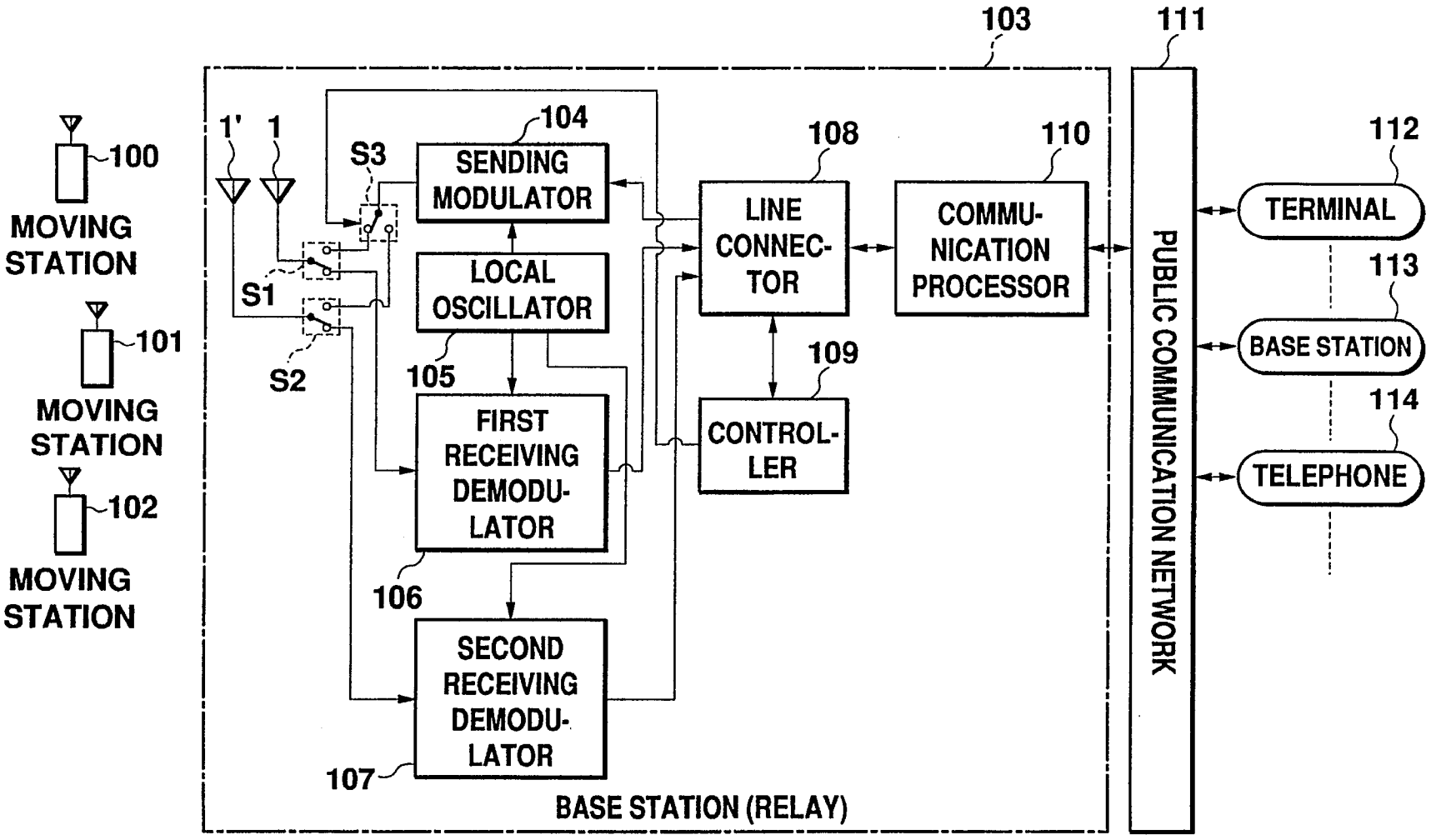
Fig. 30 PRIOR ART
FIG. 30 is a block circuit diagram showing a conventional antenna system.

FIG. 28 shows an antenna apparatus according to a twenty-fourth embodiment of the invention, illustrating an improvement of the third embodiment. A matching slot 59 is formed in the earth conductor 3, while a regulating plate 8*f* for regulating the opening area of the matching slot 59 is mounted on the support plate 15.

The operation of the antenna apparatus of the twenty-fourth embodiment will now be described. When the shapes of the slot 5 and cutouts 6 are altered, an input impedance at the antenna side as viewed from the power supply side is varied. The matching slot 59 is seen as a series inductance with respect to the line and the magnitude of its reactance will increase by increasing the length and width of the slot.

By selecting the shape and position of the matching slot 59 as follows, it is possible to reduce the change of input impedance at the antenna side, as viewed from the power supply side, even if the shape of the slot 5 and cutouts 6 is changed.

The shape and position of the matching slot 59 will now be described in connection with a system of characteristic impedance 50 ohms (Ω). Assuming that the input impedance is 50 ohms (Ω) before the shape of the slot 5 and cutouts 6 has been changed and is off 50 Ω after their shape has been changed, the resistance value of the impedance at the antenna side should be 50 ohms (Ω) and the reactance should be negative. In such a position as to satisfy this condition, there should be located a matching slot having the length and width such that an absolute value of the reactance of the slot is equal to that of the impedance at the preceding antenna side.

According to this embodiment, it is possible to obtain an antenna apparatus in which the change of the input impedance can be reduced to minimize deterioration of VSWR and hence the gain will scarcely decrease.

What is claimed is:

1. An antenna apparatus comprising:

(a) a dielectric substrate having a first surface and a second surface;

(b) an earth conductor mounted on the first surface of said dielectric substrate;

(c) a conductor mounted on the second surface of said dielectric substrate, the conductor, the earth conductor and the dielectric substrate forming a microstrip transmission line, having a length greater than a width, for transmitting an electromagnetic wave along the length of the microstrip transmission line;

(d) an antenna element formed integrally with said microstrip transmission line; and (e) a delayed wave opening situated in said earth conductor, the delayed wave opening having a width and a length, the width of the delayed wave opening being substantially less than a wavelength of the electromagnetic wave, wherein the delayed wave opening alters a phase of the electromagnetic wave so as to steer a beam direction of the antenna, the length of the delayed wave opening being greater than the width of the delayed wave opening and perpendicular to the length of the transmission line.

2. An antenna apparatus according to claim 1, wherein an edge of said delayed wave opening abuts an edge of the earth conductor.

3. An antenna apparatus comprising:

(a) a dielectric substrate having a first surface and a second surface;

(b) an earth conductor mounted on the first surface of said dielectric substrate;

(c) a conductor mounted on the second surface of said dielectric substrate, the conductor, the earth conductor and the dielectric substrate forming a microstrip transmission line, having a length greater than a width, for transmitting an electromagnetic wave along the length of the microstrip transmission line;

(d) a number of antenna elements formed integrally with said microstrip transmission line; and (e) a number of delayed wave openings situated in said earth conductor, each delayed wave opening having a width and a length, the width of the delayed wave antenna being substantially less than a wavelength of the electromagnetic wave, wherein each delayed wave opening alters a phase of the electromagnetic wave so as to steer a beam direction of the antenna, the length of each delayed wave opening being greater than the width of each delayed wave opening and perpendicular to the length of the transmission line.

4. An antenna apparatus comprising:

(a) a dielectric substrate having a first surface and a second surface;

(b) an earth conductor mounted on the first surface of said dielectric substrate;

(c) a conductor mounted on the second surface of said dielectric substrate the conductor, the earth conductor, and the dielectric substrate forming a microstrip transmission line, having a length greater than a width, for transmitting an electromagnetic wave along the length of the microstrip transmission line;

(d) an antenna element formed integrally with said microstrip transmission line;

(e) a delayed wave opening situated in said earth conductor, the delayed wave opening having a width and a length, the width of the delayed wave opening being substantially less than a wavelength of the electromagnetic wave, wherein the delayed wave opening alters a phase of the electromagnetic wave so as to steer a beam direction of the antenna, the length of the delayed wave opening being greater than the width of the delayed wave opening and perpendicular to the length of the transmission line; and (f) a conductive masking plate, covering said delayed wave opening, for controlling an effective area of said delayed wave opening to control a phase delay of the electromagnetic wave.

5. An antenna apparatus according to claim 4, wherein said masking plate is mounted on a dielectric support plate.

6. An antenna apparatus according to claim 5, wherein said dielectric support plate is in the form of a dielectric thin film.

7. An antenna apparatus according to claim 5, wherein said dielectric support plate is moveably disposed over said dielectric substrate so that the effective area of said delayed wave opening is controlled.

8. An antenna apparatus according to claim 5, wherein said dielectric support plate is slidably disposed over said dielectric substrate so that the effective area of said delayed wave opening is be controlled by sliding said dielectric support plate.

9. An antenna apparatus according to claim 8, wherein said dielectric support plate is pivotally mounted on said dielectric substrate.

10. An antenna apparatus according to claim 5, wherein said dielectric support plate is slidable in a direction along the length of the microstrip transmission line so that the effective area of said delayed wave opening is controlled by sliding of said dielectric support plate.

11. An antenna apparatus according to claim 10, wherein said dielectric support plate has an elongated hole and is adjustably secured to said dielectric substrate by a dielectric screw extending through said elongated hole of said support plate and a through hole of said dielectric substrate.

12. An antenna apparatus according to claim 11, wherein said dielectric substrate has on the conductor side a conductive receiving plate, said dielectric screw being threadedly secured to said receiving plate.

13. An antenna apparatus according to claim 11, wherein said dielectric screw secures said dielectric support plate and said dielectric substrate loosely via a spring washer so that said dielectric support plate is slidable with respect to said dielectric substrate.

14. An antenna apparatus according to claim 10, wherein said dielectric support plate is loosely secured to said dielectric substrate by a tightening means.

15. An antenna apparatus according to claim 10, wherein said dielectric support plate and said dielectric substrate are arranged in a casing, the casing being constructed and arranged to allow the dielectric support plate to slide with respect to the dielectric substrate.

16. An antenna apparatus according to claim 15, wherein said dielectric substrate and said dielectric support plate are supported and fixed in said casing by a low-dielectric-constant foaming agent.

17. An antenna apparatus according to claim 15, wherein said dielectric substrate and said dielectric support plate are fixed in said casing by a dielectric C-shaped clip.

18. An antenna apparatus according to claim 15, wherein said dielectric substrate and said dielectric support plate are supported in said casing by a dielectric pipe having an oval cross section.

19. An antenna apparatus according to claim 15, wherein said dielectric substrate is fixed in said casing, and the sliding of said dielectric support plate, with respect to said dielectric substrate is controlled from outside of said casing by a screw.

20. An antenna apparatus according to claim 15, wherein said dielectric substrate is fixed in said casing, and the sliding of said dielectric support plate, with respect to said dielectric substrate is controlled from outside of said casing by a control disc and an eccentric pin.

21. An antenna apparatus according to claim 15, wherein said dielectric substrate is fixed in said casing, and the sliding of said dielectric support plate, with respect to said dielectric substrate is controlled from outside of said casing by a V belt and pulley mechanism.

22. An antenna apparatus according to claim 15, wherein said dielectric substrate is fixed in said casing, and the sliding of said dielectric support plate, with respect to said dielectric substrate is controlled from outside of said casing by a chain feed mechanism.

23. An antenna apparatus according to claim 15, wherein said dielectric substrate is fixed in said casing, and the sliding of said dielectric support plate, with respect to said dielectric substrate is controlled from outside of said casing by a rack and pinion mechanism.

24. An antenna apparatus comprising:

(a) a dielectric substrate having a first surface and a second surface;

(b) an earth conductor mounted on the first surface of said dielectric substrate;

(c) a conductor mounted on the second surface of said dielectric substrate, the conductor, the earth conductor and the dielectric substrate forming a microstrip transmission line for transmitting an electromagnetic wave along a length of the microstrip transmission line;

(d) said earth conductor having a slit dividing said earth conductor into elongated, physically non-contacting earth conductor portions having a length greater than a width, said slit having a width substantially less than a wavelength of an operating frequency of the antenna, said slit furthermore including, a length, greater than the width, extending in a direction perpendicular to the length of the said earth conductor portions; and (e) at least one dipole antenna element formed integrally in said earth conductor including a pair of dipole conductors, each dipole conductor having a length approximately ¼ that of the wavelength and greater than a width of each dipole conductor, each dipole conductor being situated on opposite sides of said slit and having its length extending in a direction parallel to a length of a respective earth conductor portion and orthogonal to the length of said slit, said dipole antenna element being adapted to receive electromagnetic energy.

25. An antenna apparatus according to claim 24, wherein a plurality of said slits and a plurality of said dipole antenna elements are arranged along the length of said earth conductor to form an antenna array.

26. An antenna apparatus according to claim 24, further comprising a choke disposed between each conductor of said dipole antenna and said earth conductor, said choke for reducing reflections from said slit in a band of the operating frequency of the antenna.

27. An antenna apparatus according to claim 26, wherein a shape of said choke is constructed and arranged so as to have a peak frequency response for reducing reflections in the band of the operating frequency of the antenna.

28. An antenna system comprising:

a plurality of mobile stations each equipped with a transmitter/receiver; and a base station including an antenna apparatus and a communication processor for processing data received from the mobile station;

wherein the antenna apparatus further comprises;

(a) a dielectric substrate having a first surface and a second surface;

(b) an earth conductor mounted on the first surface of said dielectric substrate;

(c) a conductor mounted on the second surface of said dielectric substrate, the conductor, the earth conductor and the dielectric substrate forming a microstrip transmission line, having a length greater than a width, for transmitting an electromagnetic wave along the length of the microstrip transmission line;

(d) an antenna element formed integrally with said microstrip transmission line; and (e) a delayed wave opening situated in said earth conductor, the delayed wave opening having a width and a length, the width of the delayed wave opening being substantially less than a wavelength of the electromagnetic wave, wherein the delayed wave opening alters a phase of the electromagnetic wave so as to steer a beam direction of the antenna, the length of the delayed wave opening being greater than the width of the delayed wave opening and perpendicular to the length of the transmission line.

29. An antenna system comprising:

a plurality of mobile stations each equipped with a transmitter/receiver; and a base station including an antenna apparatus and a communication processor for processing data received from the mobile station;

wherein the antenna apparatus further comprises;

(a) a dielectric substrate having a first surface and a second surface;

(b) an earth conductor mounted on the first surface of said dielectric substrate;

(c) a conductor mounted on the second surface of said dielectric substrate the conductor, the earth conductor, and the dielectric substrate forming a microstrip transmission line, having a length greater than a width, for transmitting an electromagnetic wave along the length of the microstrip transmission line;

(d) a number of antenna elements formed integrally with said microstrip transmission line; and (e) a number of delayed wave openings situated in said earth conductor, each delayed wave opening having a width and a length, the width being substantially less than a wavelength of the electromagnetic wave, wherein each delayed wave opening alters a phase of the electromagnetic wave so as to steer a beam direction of the antenna, the length of each delayed wave opening being greater than the width of each delayed wove opening and perpendicular to the length of the transmission line.

30. An antenna system comprising:

a plurality of mobile stations each equipped with a transmitter/receiver; and a base station including an antenna apparatus and a communication processor for processing data received from the mobile station;

wherein the antenna apparatus further comprises;

(a) a dielectric substrate having a first surface and a second surface;

(b) an earth conductor mounted on the first surface of said dielectric substrate;

(c) a conductor mounted on the second surface of said dielectric substrate the conductor, the earth conductor, and the dielectric substrate forming a microstrip transmission line, having a length greater than a width, for transmitting an electromagnetic wave along the length of the microstrip transmission line;

(d) an antenna element formed integrally with said microstrip transmission line;

(e) a delayed wave opening situated in said earth conductor, the delayed wave opening having a width and a length, the width of the delayed wave opening being substantially less than a wavelength of the electromagnetic wave, wherein the delayed wave opening alters a phase of the electromagnetic wave so as to steer a beam direction of the antenna, the length of the delayed wave opening being greater than the width of the delayed wave opening and perpendicular to the length of the transmission line; and (f) a conductive masking plate covering said delayed wave opening for controlling an effective area of said delayed wave opening to control a phase delay of the electromagnetic wave.

31. An antenna system comprising:

a plurality of mobile stations each equipped with a transmitter/receiver: and a base station including an antenna apparatus and a communication processor for processing data received from the mobile station;

the antenna apparatus comprising;

(a) a dielectric substrate having a first surface and a second surface;

(b) an earth conductor mounted on the first surface of said dielectric substrate;

(c) a conductor mounted on the second surface of said dielectric substrate, the conductor, the earth conductor and the dielectric substrate forming a microstrip transmission line for transmitting an electromagnetic wave along a length of the microstrip transmission line;

(d) said earth conductor having a slit dividing said earth conductor into elongated, physically non-contacting earth conductor portions having a length greater than a width, said slit having a width substantially less than a wavelength of an operating frequency of the antenna, said slit furthermore including, a length, greater than the width, extending in a direction perpendicular to the length of the said earth conductor portions; and (e) at least one dipole antenna element formed integrally in said earth conductor including a pair of dipole conductors, each dipole conductor having a length approximately ¼ that of the wavelength and greater than a width of each dipole conductor, each dipole conductor being situated on opposite sides of said slit and having its length extending in a direction parallel to a respective length of a non-contacting conductor portion and orthogonal to the length of said slit, said dipole antenna element being adapted to receive electromagnetic energy.

32. An antenna apparatus comprising:

(a) a dielectric substrate having a first surface and a second surface;

(b) an earth conductor mounted on the first surface of said dielectric substrate;

(c) a conductor mounted on the second surface of said dielectric substrate, the conductor, the earth conductor and the dielectric substrate forming a microstrip transmission line, having a length greater than a width, for transmitting an electromagnetic wave along the length of the microstrip transmission line;

(d) an antenna element formed integrally with said microstrip transmission line; and (e) a delayed wave opening situated in said earth conductor that alters a phase of the electromagnetic wave without increasing a physical path length of the microstrip transmission line so as to steer a beam direction of the antenna, the delayed wave opening having a width and a length, the width being substantially less than a wavelength of the electromagnetic wave, the length, of the delayed wave opening, being greater than the width and perpendicular to the length of the transmission line.

33. An antenna apparatus comprising:

(a) a dielectric substrate having a first surface and a second surface;

(b) an earth conductor mounted on the first surface of said dielectric substrate;

(c) a conductor mounted on the second surface of said dielectric substrate the conductor, the earth conductor, and the dielectric substrate forming a microstrip transmission line, having a length greater than a width, for transmitting an electromagnetic wave along the length of the microstrip transmission line;

(d) a number of antenna elements formed integrally with said microstrip transmission line; and (e) a number of delayed wave openings situated in said earth conductor that alter a phase of the electromagnetic wave without increasing a physical path length of the microstrip transmission line so as to steer a beam direction of the antenna, each delayed wave opening having a width and a length, the width being substantially less than a wavelength of the electromagnetic wave, the length of each delayed wave opening being greater than the width of each delayed wave opening and perpendicular to the length of the transmission line.

34. An antenna apparatus comprising:

(a) a dielectric substrate having a first surface and a second surface;

(b) an earth conductor mounted on the first surface of said dielectric substrate;

(c) a conductor mounted on the second surface of said dielectric substrate, the conductor, the earth conductor and the dielectric substrate forming a microstrip transmission line for transmitting an electromagnetic wave along a length of the microstrip transmission line;

(d) a number of antenna elements formed integrally with said microstrip transmission line; and (e) a number of delayed-wave openings situated in said earth conductor that provide a serial inductance in the microstrip transmission line, wherein each delayed wave opening alters a phase of the electromagnetic wave so as to steer a beam direction of the antenna apparatus.

35. An antenna apparatus comprising:

(a) a dielectric substrate having a first surface and a second surface;

(b) an earth conductor mounted on the first surface of said dielectric substrate;

(c) a conductor mounted on the second surface of said dielectric substrate the conductor, the earth conductor, and the dielectric substrate forming a microstrip transmission line for transmitting an electromagnetic wave along a length of the microstrip transmission line;

(d) an antenna element formed integrally with said microstrip transmission line; and (e) a delayed-wave opening situated in said earth conductor that provide a serial inductance in the microstrip transmission line to alter a phase of the electromagnetic wave so as to steer a beam direction of the antenna element.

* * * * *